US008038366B2

(12) United States Patent
Halonen et al.

(10) Patent No.: US 8,038,366 B2
(45) Date of Patent: Oct. 18, 2011

(54) WHEELED CONCRETE SCREEDING DEVICE

(75) Inventors: Philip D. Halonen, Calumet, MI (US); Russ E. Stein, Houghton, MI (US); Mark A. Pietila, Atlantic Mine, MI (US); Michael R. Keranen, Howell, MI (US); Carl B. Kieranen, Chassel, MI (US)

(73) Assignee: Somero Enterprises, Inc., Fort Myers, FL (US)

( * ) Notice: Subject to any disclaimer, the term of this patent is extended or adjusted under 35 U.S.C. 154(b) by 0 days.

(21) Appl. No.: 12/951,532

(22) Filed: Nov. 22, 2010

(65) Prior Publication Data

US 2011/0064518 A1 Mar. 17, 2011

Related U.S. Application Data

(63) Continuation of application No. 12/186,164, filed on Aug. 5, 2008, now Pat. No. 7,854,565, which is a continuation of application No. 11/674,303, filed on Feb. 13, 2007, now Pat. No. 7,407,339, which is a continuation of application No. 11/189,396, filed on Jul. 26, 2005, now Pat. No. 7,195,423.

(60) Provisional application No. 60/521,950, filed on Jul. 26, 2004, provisional application No. 60/619,672, filed on Oct. 18, 2004, provisional application No. 60/666,672, filed on Mar. 30, 2005.

(51) Int. Cl.
*E01C 19/22* (2006.01)

(52) U.S. Cl. ..... 404/118; 404/84.5; 404/101; 404/114

(58) Field of Classification Search ..... 404/83–86, 404/93, 96, 102, 113, 114, 118
See application file for complete search history.

(56) References Cited

U.S. PATENT DOCUMENTS 1,695,202 A 12/1928 Newell (Continued)

FOREIGN PATENT DOCUMENTS

CA 2051776 12/1995

(Continued)

OTHER PUBLICATIONS

Screed King TSK 308 Brochure "Are you Tired of Screeding Concrete This Way?", believed to be published more than one year prior to the filing date of the present application.

(Continued)

*Primary Examiner* — Raymond Addie

(74) *Attorney, Agent, or Firm* — Gardner, Linn, Burkhart & Flory, LLP

(57) ABSTRACT

A wheeled concrete screeding device includes a wheeled unit having wheels for movably supporting a frame portion, and a screed head supported at the frame portion and following behind the wheeled unit when the wheeled unit is moved in a screeding direction. The screed head includes a grade establishing element and a vibratable member. The grade establishing element is generally vertically adjustable responsive to a signal from a laser receiver disposed at the screed head to establish a struck-off surface of the uncured concrete at a desired grade. The vibratable member is adjustably attached at the grade establishing element and the vibratable member at least partially floats behind the grade establishing element on the struck-off surface of the uncured concrete and is at least partially supported at the struck-off surface of the uncured concrete as the wheeled unit is moved in the screeding direction.

20 Claims, 18 Drawing Sheets

U.S. PATENT DOCUMENTS 2,009,542 A 7/1935 Day
2,032,205 A 2/1936 Gage
2,219,246 A 10/1940 Jackson
2,255,343 A 9/1941 Baily
2,303,335 A 12/1942 Day
2,373,828 A 4/1945 Harrington
2,400,321 A 5/1946 Troxell
2,449,851 A 9/1948 Jackson
2,453,510 A 11/1948 Jackson
2,599,330 A 6/1952 Jackson
2,796,685 A 6/1957 Bensinger
2,916,836 A 12/1959 Stewart et al.
3,088,384 A 5/1963 Heer et al.
3,147,678 A 9/1964 Lewis
3,262,378 A 7/1966 Schrimper et al.
3,396,642 A 8/1968 Martinson
3,403,609 A 10/1968 Bradshaw et al.
3,415,173 A 12/1968 Paul
3,540,360 A 11/1970 Snow et al.
3,604,325 A 9/1971 Borges
3,838,933 A 10/1974 Lehman et al.
3,850,541 A 11/1974 Baillet et al.
3,870,427 A 3/1975 Allen
3,914,064 A 10/1975 Gurries
3,953,145 A 4/1976 Teach
4,249,327 A 2/1981 Allen
4,299,290 A 11/1981 Nunes
4,318,631 A 3/1982 Vickers
4,379,653 A 4/1983 Brown
4,408,978 A 10/1983 Owens
4,427,358 A 1/1984 Stilwell
4,470,783 A 9/1984 Friebel et al.
4,614,486 A 9/1986 Bragagnini
4,655,633 A 4/1987 Somero et al.
4,734,022 A 3/1988 Shimabukuro
4,807,131 A 2/1989 Clegg
4,838,730 A 6/1989 Owens
4,861,188 A 8/1989 Rouillard
4,930,935 A 6/1990 Quenzi et al.
4,933,853 A 6/1990 Musil et al.
4,978,246 A 12/1990 Quenzi et al.
5,039,249 A 8/1991 Hansen et al.
5,062,738 A 11/1991 Owens
5,080,525 A 1/1992 Bricher et al.
5,129,803 A * 7/1992 Nomura et al. ..... 425/62
5,156,487 A 10/1992 Haid
5,190,401 A 3/1993 Wilson
5,224,793 A 7/1993 De Pol et al.
5,258,961 A 11/1993 Sehr et al.
5,279,501 A 1/1994 Shelley
5,288,166 A 2/1994 Allen et al.
5,288,167 A 2/1994 Gaffard et al.
5,328,295 A 7/1994 Allen
5,352,063 A 10/1994 Allen et al.
5,375,663 A 12/1994 Teach
5,549,412 A 8/1996 Malone
5,567,075 A 10/1996 Allen
5,588,776 A 12/1996 Swisher, Jr. et al.
5,607,205 A * 3/1997 Burdick et al. ..... 299/1.5
5,752,783 A 5/1998 Malone
5,771,978 A 6/1998 Davidson et al.
5,778,482 A 7/1998 Sbrigato
5,779,390 A 7/1998 Tuusinen
5,803,656 A 9/1998 Turck
5,807,022 A 9/1998 McCleary
5,924,819 A 7/1999 Breidenbach
6,022,171 A * 2/2000 Munoz ..... 404/124
6,029,752 A 2/2000 Young
6,056,474 A 5/2000 Nolan
6,089,787 A 7/2000 Allen et al.
6,129,481 A 10/2000 Tapio et al.
6,152,647 A 11/2000 Tapio et al.
6,174,105 B1 1/2001 Holmes et al.
6,183,160 B1 2/2001 Tapio et al.
6,227,761 B1 5/2001 Kieranen et al.
6,238,135 B1 5/2001 Rower
6,336,769 B1 1/2002 Cincis et al.
6,588,976 B2 7/2003 Quenzi et al.
6,623,208 B2 9/2003 Quenzi et al.
6,672,797 B1 * 1/2004 Zachman et al. ..... 404/84.5
6,679,652 B2 1/2004 Suriano
6,685,390 B1 2/2004 Eitzen
6,860,676 B2 3/2005 Pont Feixes
6,923,595 B1 8/2005 Chek
6,953,304 B2 10/2005 Quenzi et al.
6,976,805 B2 12/2005 Quenzi et al.
7,121,762 B2 10/2006 Quenzi et al.
7,195,423 B2 3/2007 Halonen et al.
7,357,596 B2 4/2008 Face, III et al.
7,407,339 B2 8/2008 Halonen et al.
7,854,565 B2 * 12/2010 Halonen et al. ..... 404/75
2006/0018715 A1 1/2006 Halonen et al.

FOREIGN PATENT DOCUMENTS

DE 42402 11/1965
EP 0 743 408 B1 10/1998
EP 1887138 2/2008
ES 1 052 554 U 1/2003
ES 1 056 566 U 4/2004
ES 1 059 142 U 12/2004
FR 636563 4/1928
JP 06306813 A 1/1994
WO WO 02/25016 3/2002

OTHER PUBLICATIONS

European Search Report for corresponding European Application No. 05784217.1.

* cited by examiner

WHEELED CONCRETE SCREEDING DEVICE

CROSS REFERENCE TO RELATED APPLICATIONS

The present application is a continuation of U.S. patent application Ser. No. 12/186,164, filed Aug. 5, 2008, now U.S. Pat. No. 7,854,565, which is a continuation of U.S. patent application Ser. No. 11/674,303, filed Feb. 13, 2007, now U.S. Pat. No. 7,407,339, which is a continuation of U.S. patent application Ser. No. 11/189,396, filed Jul. 26, 2005, now U.S. Pat. No. 7,195,423, which claims benefit of U.S. provisional applications Ser. No. 60/521,950, filed Jul. 26, 2004; Ser. No. 60/619,672, filed Oct. 18, 2004; and Ser. No. 60/666,672, filed Mar. 30, 2005, which are all hereby incorporated herein by reference in their entireties.

FIELD OF THE INVENTION

The present invention relates generally to raking or striking-off devices for striking-off uncured concrete at floors and surfaces.

BACKGROUND OF THE INVENTION

One common practice for the placement of concrete during the construction of slab-on-grade concrete surfaces and floors is to discharge concrete directly from concrete delivery trucks via a chute onto a subgrade upon which the slab will be formed. In some cases, such as where the truck has a front discharge chute, only the truck driver is required to perform the task of controlling the concrete chute from the driver's seat. However, considerable manual labor is required to spread the concrete to a reasonably uniform depth for subsequent strike-off or screeding. Automated laser system responsive screeding machines; such as a Laser Screed machine manufactured by Somero Enterprises of Houghton, Mich., USA (and/or such as the types described in U.S. Pat. Nos. 4,655,633; 4,930,935; 6,129,481; 6,152,647; 6,183,160; 6,588,976; and/or 6,623,208, which are hereby incorporated herein by reference), reduce the manual labor of screeding concrete substantially over large areas. However, in many instances where such a screeding machine cannot be used, the concrete still must be spread out or struck-off in a somewhat uniform fashion by manual effort which is very labor intensive and costly.

Therefore, there is a need in the art for an improved striking-off or raking apparatus and/or method that requires less manual labor and thus overcomes the shortcomings of the prior art.

SUMMARY OF THE INVENTION

The present invention provides a power rake or plow apparatus for striking-off uncured concrete that is moved and/or controlled by an operator walking behind the apparatus as the apparatus is moved over and along and through the uncured concrete. The apparatus includes a wheeled base unit and a plow assembly that is adjustably mounted to the wheeled base unit and adjustable to strike-off the concrete at a desired level or grade. The plow assembly may be adjustable in response to a laser plane reference system. The plow assembly may include a vibrating member to vibrate, compact and smooth the concrete at the desired grade as established by the plow or grade setting device.

According to an aspect of the present invention, a wheeled concrete working device that is movable over a surface of uncured concrete (that has been placed on a subgrade surface) and operable to establish a desired grade of the uncured concrete surface includes a wheeled support, a plow assembly and a controller. The wheeled support includes a frame portion and a pair of wheels rotatably mounted at the frame portion. The wheeled support is selectively movable in a forward direction and a rearward direction. The plow assembly is mounted to the frame portion and includes at least one plow member for engaging the concrete when the wheeled support is moved in the rearward direction. The device is operable in response to a signal from a laser receiver mounted at the plow assembly to adjust an elevation of the plow member to establish a desired grade of the concrete when the wheeled support is moved in the rearward direction. The controller automatically controls the elevation of the plow member in response to a direction signal indicative of the direction of travel of the wheeled support and controls the elevation of the plow member irrespective of the signal from the laser receiver when the direction signal is indicative of the wheeled support at least one of stopping and moving in the forward direction.

According to another aspect of the present invention, a wheeled concrete working device that is movable over a surface of uncured concrete and operable to establish a desired grade of the uncured concrete surface includes a wheeled support, a plow assembly and a user input. The wheeled support is selectively movable in a forward direction and a rearward direction. The wheeled support comprises a forward frame portion supported by at least one front wheel and a rearward frame portion pivotally attached to the forward frame portion and supported by at least one rear wheel. The plow assembly is mounted to the forward frame portion and includes at least one plow member for engaging and establishing the desired grade of the concrete when the wheeled support is moved in the rearward direction. The device is operable in response to a signal from a laser receiver mounted at the plow assembly to adjust an elevation of the plow member to establish the desired grade of the concrete when the wheeled support is moved in the rearward direction. The user input is adjustable by an operator of the wheeled concrete working device to adjust a down pressure of the plow assembly at the concrete when the wheeled support is moved in the rearward direction.

According to another aspect of the present invention, a wheeled concrete working or processing device or machine may include a bump detecting device that is operable to detect a surface irregularity of the subgrade upon which the wheels travel and at a location rearward or ahead of either of the wheels and in the rearward direction of travel of the wheeled support. The controller may be operable to reduce the rearward speed of the wheeled support in response to a detection of a surface irregularity by the bump detecting device. The controller may control the frame portion and/or the plow assembly to substantially maintain the plow assembly at a desired orientation when at least one of the wheels engages the detected surface irregularity. The controller may be operable to increase the rearward speed of the wheeled support after the wheels have passed the detected surface irregularity. The wheeled support may comprise a four-wheeled support having a forward frame portion supported by a pair of front wheels and a rearward frame portion pivotally attached to the forward frame portion and supported by a pair of rear wheels, with the plow assembly being mounted to the forward frame portion. The bump detecting device may comprise a rear level sensor located at the rear frame portion. The rear level sensor may detect a tilt of the rear frame portion about a longitudinal axis of the rear frame portion, where the detected tilt is indicative of one of the rear wheels engaging a surface irregularity.

According to yet another aspect of the present invention, a wheeled strike-off device is movable over a surface of uncured concrete or subgrade materials and is operable to establish a desired grade of the uncured concrete surface or subgrade surface. The wheeled strike-off device includes a wheeled support and a plow assembly. The wheeled support has a frame portion and a pair of first wheels rotatably mounted at or near a first end of the frame portion, and a second wheel rotatably mounted at or near a second end of the frame portion. The second wheel is pivotable about a generally vertical pivot axis to assist in steering the strike-off device as it is moved over the surface. The plow assembly is adjustably mounted to the frame portion and is vertically adjustable relative to the frame portion via an actuator. The plow assembly includes at least one plow member for engaging the uncured concrete or subgrade materials and establishing the desired grade.

The actuator may be automatically adjustable in response to a laser leveling system. The plow assembly may include a first plow member facing in a first direction and a second plow member facing in a second direction, with the first direction being generally opposite to the second direction. The first plow may establish the desired grade when the wheeled support is moved in the first direction and the second plow may establish the desired grade when the wheeled support is moved in the second direction. Optionally, the plow assembly may be adjustable relative to the wheeled support about a longitudinal axis of the wheeled support.

The first wheels may be independently rotatably driven to move and steer the strike-off device over and through the uncured concrete surface. The second wheel may be rotatably driven to move the strike-off device. The wheeled support may include a handle portion that extends from the second end of the wheeled support and that is connected to the second wheel, such that pivotal movement of the handle portion imparts a corresponding pivotal movement of the second wheel to steer the wheeled support.

According to another aspect of the present invention, a method of establishing a desired grade of an uncured concrete surface or subgrade surface includes providing a wheeled strike-off device having a wheeled support and a plow assembly. The wheeled support has a frame portion, a pair of first wheels rotatably mounted at or near a first end of the frame portion, and a second wheel rotatably mounted at or near a second end of the frame portion. The plow assembly is adjustably mounted to the frame portion and is vertically adjustable relative to the frame portion via an actuator. The plow assembly includes at least one plow member for engaging and establishing the desired grade. The strike-off device is moved over a surface of uncured concrete or subgrade materials. The plow assembly is adjusted relative to the wheeled support to establish the desired grade as the strike-off device is moved over the surface. The second wheel is pivoted about a generally vertical pivot axis to assist in steering the strike-off device as it is moved over the surface.

According to another aspect of the present invention, a screeding device that is manually movable over a surface of uncured concrete placed between opposite forms, and that is operable to level and smooth the uncured concrete surface to a level set by the forms, includes a wheeled unit, a plow and a concrete surface working member, such as a vibrating member or the like. The wheeled unit has a frame portion and at least one wheel rotatably mounted to the frame portion. The plow is mounted to a rear portion of the frame portion and includes a spacing element for spacing the plow at a desired level above the forms. The concrete surface working member is attached to the plow and positioned rearward of the plow, The concrete surface working member is at least partially supportable on the forms, and works the uncured concrete to a finished condition at a level generally defined by the forms and below the level of the plow.

The spacing element may comprise a pair of spacing elements, with each of the spacing elements being positioned along a lower edge of the plow at or near an end of the plow. Each of the spacing elements may include a curved lower lip that substantially encompasses the lower edge of the plow.

Optionally, a powered, laser controlled, four wheel, articulated, strike-off plow, and raking machine or four wheel power rake may be implemented to screed a concrete surface. In one form, the machine is intended for striking-off and leveling uncured concrete and loose subgrade materials. A plow head assembly is attached to the front of the machine for leveling materials whereby a laser leveling system is included to provide automated leveling and power raking of materials to a desired grade elevation.

A further aspect of the present invention beyond power raking is a machine that can be readily adapted for other uses by a concrete construction contractor with appropriate and optional sets of accessories and attachments. The plow head assembly may be quickly and/or readily detached from the front of the machine and another assembly installed. For example, the machine can be adapted to become a sprayer with a boom containing spray nozzles, a pressurized fluid pumping system, and a reservoir of fluid material, in order to apply sprayed-on coatings and sealers to a freshly cured concrete surface. Optionally, for example, the machine can be adapted to become an automated, laser system responsive screeding machine with a screed head attachment to provide a drive-through-the concrete, laser-guided, concrete strike-off, screeding and finishing machine. Optionally, for example, the machine can be adapted to become a hose handler to drag and otherwise move concrete pumping supply hose at construction sites where concrete is being pumped from a pumping unit to a location where concrete placing operations are taking place. Optionally, for example, the machine can be adapted for use as a powered sweeper having a cylindrical rotating brush attachment where the rotating axis of the brush is roughly parallel to the surface being swept.

Each of these adaptable uses provides the concrete construction contractor with a machine having a high level of machine utility and utilization. Thus, the present invention provides a significant increase in productivity, ease of effort, and profitability to the concrete construction industry.

Therefore, the present invention provides a strike-off device and method that provides a desired and accurate strike-off or raking of an uncured concrete surface or of subgrade materials. The device or apparatus or machine may be moved in either direction to strike-off or establish the desired grade or level of the uncured concrete or subgrade material. The plow is automatically adjusted to maintain the desired grade or level in response to a laser reference system, so that the uncured concrete or subgrade materials are struck-off at the appropriate level over the targeted area. The wheels of the machine may be independently operable or controlled to move the machine over and through the uncured concrete or subgrade materials and to turn or steer the machine as it is moved over and through the uncured concrete or subgrade materials. The rear wheel may be steered via a handlebar or the like to further enhance the steering and controlling of the machine as it is moved over and through the uncured concrete or subgrade materials. The present invention thus provides a strike-off or raking device or apparatus or machine that substantially reduces the manual labor required to strike-off the uncured concrete or subgrade materials, since an operator need only walk behind the apparatus (or in front of the apparatus, depending on the direction of travel of the apparatus) and control and/or steer the apparatus to establish the desired grade.

The present invention also provides a sidewalk screeding machine that is operable to establish an initial grade of uncured concrete that is slightly above the desired final grade and then to screed the uncured concrete at the initial grade and compact and vibrate the uncured concrete to the final grade, without the use of laser leveling or grade setting systems or the like. The plow functions to cut or establish an initial grade or level of the uncured concrete that is above the level or grade at which the concrete surface working member or vibrating member will work and/or vibrate and/or screed the concrete. The plow thus leaves a small amount of excess concrete for the vibrating member to compact and screed so that the vibrating member provides an enhanced surface of the concrete slab.

These and other objects, advantages, purposes and features of the present invention will become apparent upon review of the following specification in conjunction with the drawings.

DESCRIPTION OF THE PREFERRED EMBODIMENTS

Figure 1:
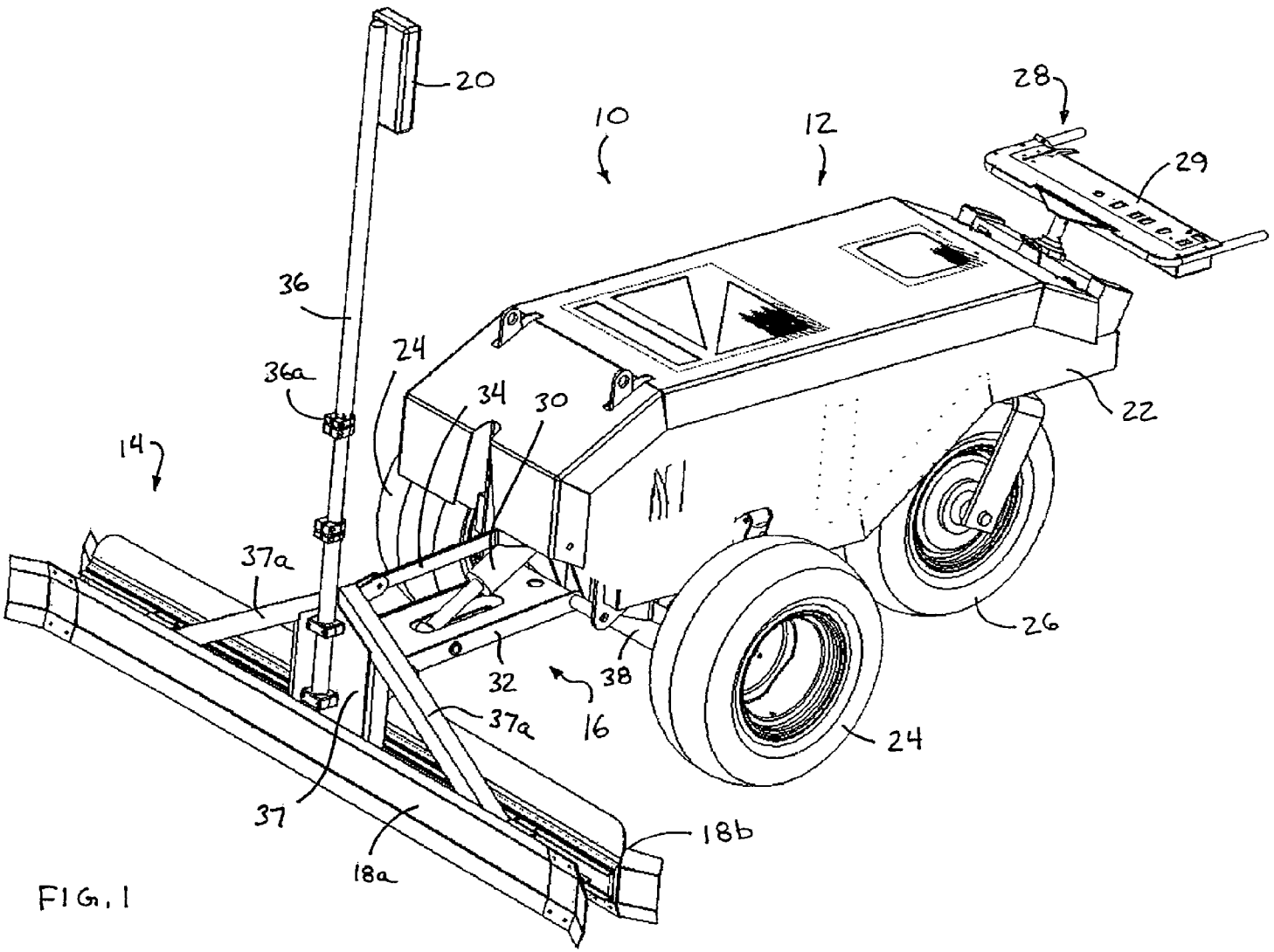
FIG. 1 is a perspective view of a powered strike-off apparatus in accordance with the present invention.
Figure 2:
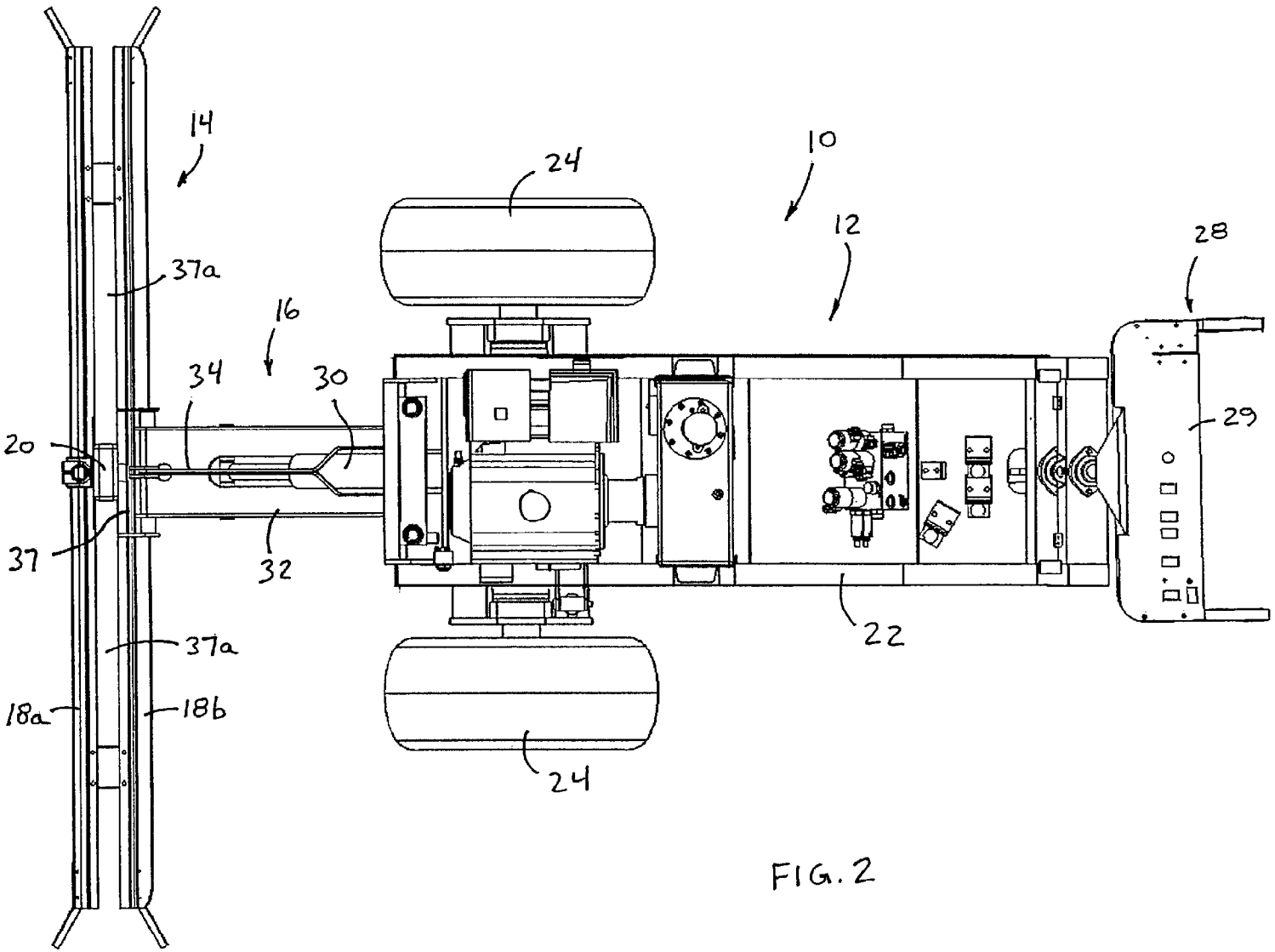
FIG. 2 is a top plan view of the powered strike-off apparatus of FIG. 1.

Referring now specifically to the drawings and the illustrative embodiments depicted therein, a power rake or powered plow or strike-off or raking apparatus or machine 10 is operable to rake or plow or otherwise establish the grade of uncured concrete or subgrade materials as the machine is moved over and through the uncured concrete or subgrade materials. Strike-off apparatus 10 includes a wheeled base unit 12 and a plow head or assembly 14 adjustably mounted to base unit 12 and adjustable relative thereto via an adjustment mechanism or linkage 16. Plow assembly 14 includes a strike-off member or plow, such as a forward facing plow 18*a* and a rearward facing plow 18*b*, for engaging and striking-off the uncured concrete or subgrade materials at the desired grade. The level or grade of plows 18*a*, 18*b* may be adjusted relative to base unit 12 in response to a signal from a laser receiver 20 of a laser plane generating system, as discussed below. The wheeled base unit 12 may be driven and steered by an operator walking behind the apparatus, as also discussed below.

Wheeled base unit 12 includes a frame 22 supported by a pair of rubber-tired wheels 24 at one end and a single rubber-tired wheel 26 at the other end. The wheels may be rotatably driven via respective hydraulic motors or the like to provide driving of the apparatus over and through the uncured concrete or subgrade materials. The wheel 26 may be turned relative to the frame 22 to steer the apparatus, such as via a handlebar 28 or the like at the wheel 26. In the illustrated embodiment, the handlebar 28 may support a control panel 29 for an operator to actuate to control the various valves and motors of the strike-off apparatus as the operator walks behind the strike-off apparatus.

The strike-off apparatus 10 thus is a walk-behind machine with rubber-tired wheels, two in the front and one in the rear. Power for driving the hydraulic motors may be provided via any known power source or power means, such as via a gasoline powered internal combustion engine or the like (although other power means, such as electric motors, diesel engines or the like may be implemented without affecting the scope of the present invention). The base unit 12 may include the mechanical frame and components, a supply of hydraulic fluid or oil in a reservoir, a hydraulic pump, control valves, hydraulic pressure lines, and an electrical system including a battery and charging system.

The plow head assembly 14 consists of a forward facing plow 18*a* and a rearward facing plow 18*b* so that the strike-off apparatus may be operable in either direction. The plow head assembly 14 is able to either push or pull loose material, such as freshly poured concrete or subgrade materials, such as sand, dirt or gravel or the like, as the plow head is moved over and through the material via driving of the wheel motors of the wheeled support unit.

The plow assembly 14 is attached to the front of the machine through a mechanical linkage or lift mechanism 16 and a hydraulic actuator 30. In the illustrated embodiment, the plow head or plow assembly 14 is supported by the linkage or mechanism 16, which includes a lift arm 32 and an upper tie-rod or head support link 34, and the hydraulic actuator or cylinder 30, which form a vertically movable mechanical linkage. Extension and retraction of actuator 30 causes the plow assembly 14 to lower and raise, respectively, relative to wheeled support 12 via pivotal movement of lift arm 32 and upper link 34 simultaneously relative to the rear end of wheeled support 12. The movement of the linkages 16 relative to wheeled support 12 and to the plow assembly provides generally vertical reciprocal movement of the plow assembly relative to the wheeled support, such that the plow assembly and plows 18*a*, 18*b* may remain in generally the same orientation as the plow assembly is raised or lowered relative to wheeled support 12.

The height or elevation of the plows 18*a*, 18*b* may be controlled by an automated laser control system having a laser receiver 20 attached to the plow by a mast 36. The mast 36 that supports the laser receiver 20 is located at a generally middle region of the plow. As can be seen in FIG. 1, mast 36 may be mounted to a central plate 37, which also mounts to lift aim 32 and link 34 of lift mechanism 16. A pair of cross members 37*a* extend from an upper portion of plate 37 outward and downward to the plows 18*a*, 18*b* to support the plows 18*a*, 18*b* and to provide enhanced rigidity of the plows.

The laser receiver 20 may be adjusted to a desired height above the plows 18*a*, 18*b* via adjustment collars 36*a* on mast 36 that may allow for extension or retraction of mast 36, which may be a telescoping rod or mast or the like. A laser transmitter (not shown) provides a laser reference plane for the machine The actuator 30 thus may be automatically adjusted or extended/retracted and controlled in response to a laser reference plane system, preferably using laser beacon receivers and a laser reference plane generator that establishes a laser reference plane at the worksite, such as the types described in U.S. Pat. Nos. 4,655,633 and/or 4,930,935, which are hereby incorporated herein by reference. For example, a standard laser control system provided by Trimble Navigation comprising the GCR Laser Control System package may be adapted to the machine to actively control the elevation of the plow head. The laser system may control a hydraulic valve which in turn controls the position of the hydraulic actuator 30 at the plow in response to the position or level of the laser reference plane at the laser receiver while the machine is in operation.

Figure 3:
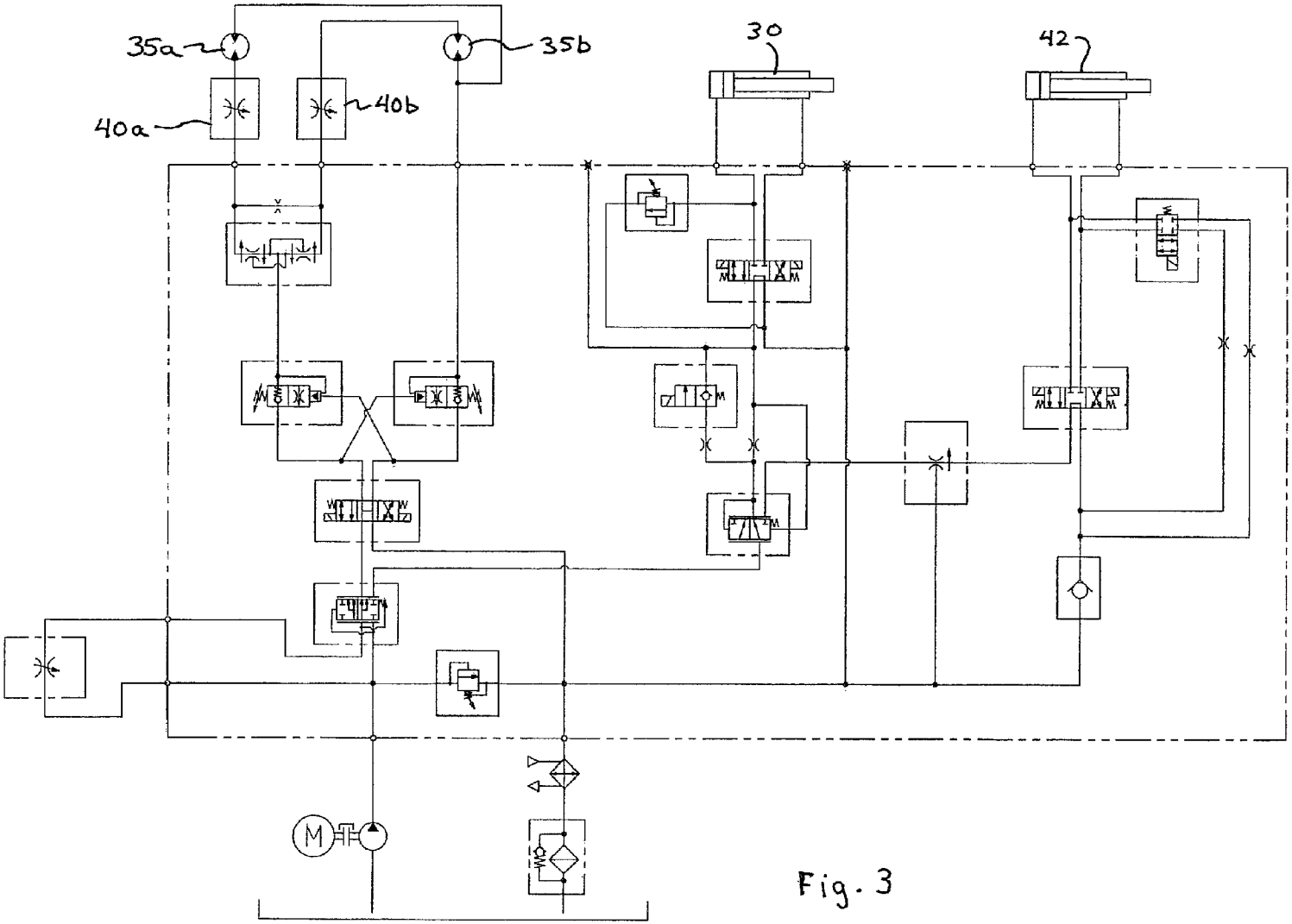
FIG. 3 is a hydraulic schematic of a hydraulic system useful with the powered strike-off apparatus of the present invention.

During operation, an operator stands nearest the single rear wheel 26 and controls and steers the machine at the handlebar 28 and control panel 29. The front wheels 24 are driven, such as via respective hydraulic drive motors 35*a*, 35*b* (FIG. 3), and may be independently driven or powered unequally to help steer the machine as the operator controls the handlebars at the rear. The rear wheel can also be turned by the operator through the handlebars to steer the machine. However, the machine may also self-steer via the effect of caster wheel action at the rear wheel (where the rear wheel may freely pivot as the front wheels are independently driven to cause turning of the machine), without affecting the scope of the present invention.

In a preferred embodiment, two hydraulic flow control valves 40*a*, 40*b* are connected to the respective front wheel drive motors 35*a*, 35*b* and are actuated by turning of the handlebars, such as by mechanical cables (not shown) or small chains or members or the like attached to the steering column or shaft or the like. The hydraulic valves help control the steering of the machine and may be actuated by the turning of the handlebars. For example, when the handlebar is turned one way, one of these valves will close by an amount that is determined by how far the handlebar is turned in that direction (either left or right). As the respective hydraulic valve closes, it reduces the flow of hydraulic oil delivered to the respective drive motor at the inside of the turn. This creates a differential flow to the drive motors and causes one of the front wheels to rotate more than the other, which in turn causes the machine to turn more easily either left or right under power.

In addition to providing propulsion power to drive the machine and provide powered steering, the front wheel axle assembly may also have the ability to oscillate or tilt the machine and plow head side-to-side with respect to the horizontal. For example, the front wheels may be attached to a single axle member or subframe 38 (FIG. 1). The axle may have a generally horizontal pivot axis that is generally parallel to the ground and that extends generally parallel to the direction of travel of the machine as the machine is moved during normal operation. Side-to-side tilting or oscillation of the machine is controlled by extension and retraction of an actuator 42 (FIG. 3), such as a hydraulic actuator or the like, where a first end of the actuator is attached to the frame of the machine and a second end of the actuator is attached to the axle or subframe. The operator may control the amount of tilt of the machine and plow head by a control switch or lever at the control panel 29 at the handlebars 28.

The tilting of the framework and plow assembly relative to the axle or subframe allows the machine and operator to adjust and maintain a generally horizontal position of the plow head and plows with respect to the desired grade when the wheels of the base unit encounter variations in the subgrade that may cause the machine to tip or tilt either left or right. Thus, the operator may manually control the machine speed, steering of the machine, forward and reverse direction of travel, and side-to-side or horizontal leveling position of the plow, while the elevation of the plow head may be automatically controlled by the laser control system. The controls for these functions may be provided at the control panel 29 at the handlebars 28, where they are readily accessible by the operator walking behind the strike-off machine 10.

Optionally, it is envisioned that the strike-off apparatus or machine of the present invention may alternately include an auger (or other means for moving or striking-off or raking the uncured concrete or subgrade materials) positioned at the forward or rearward portion of the plow assembly, whereby the auger may be operable to cut or establish the grade height of the concrete or subgrade as the strike-off apparatus is moved along and through the uncured concrete or subgrade materials. Such an embodiment may or may not include a strike-off plow at either or both ends. The auger may replace the function of this component entirely or, optionally, the auger may supplement engagement and strike-off of the concrete or subgrade materials, without affecting the scope of the present invention.

The strike-off apparatus of the present invention thus may be suitable to facilitate and improve the accuracy of rough raking of uncured concrete and subgrade materials. The strike-off apparatus may reduce labor and increase productivity and may be quite versatile for use on many types of construction jobs. The strike-off apparatus of the present invention is especially well suited to the small to mid-size company contractor who may already use various types of screeding devices, such as, for example, the Somero Copperhead Laser Screed machine and/or Copperhead XD Laser Screed machine, which are commercially available from Somero Enterprises of Houghton, Mich., and which are described in U.S. patent application Ser. No. 10/728,620, filed Dec. 5, 2003, now U.S. Pat. No. 6,953,304; Ser. No. 10/266,305, filed Oct. 2, 2002, now U.S. Pat. No. 6,976,805; and Ser. No. 10/902,528, filed Jul. 29, 2004, now U.S. Pat. No. 7,121,762, which are hereby incorporated herein by reference, or various types of hand-held vibratory screeds, and/or even simple wooden "2×4" hand-held screeds or the like.

The strike-off apparatus of the present invention is preferably small and light enough in weight such that it can be used on elevated decks in addition to on grade sites, thus supplementing the concrete placement work of concrete delivery trucks, pumps, and buggies and the like.

The strike-off apparatus of the present invention will also help the contractor with subgrade work by having the ability to grade and smooth loose earth working materials such as dirt, sand, and gravel and/or the like. The height of the plow is automatically maintained at the correct elevation by the laser control system. This makes the present invention highly suitable for the powered leveling of dirt, sand, or gravel in relatively small areas before concrete is poured or before precast paving stones or "pavers" are installed to create a finished driveway or sidewalk, for example. Accurate grading of the subgrade improves concrete yield by reducing the chance of low spots in the subgrade and any resulting thicker sections of concrete. High spots in the subgrade are also minimized, which reduces the chances for thin sections in the finished concrete where reduced strength and cracking may occur. Precast paving stones and pavers can also be installed on a more accurately prepared subgrade. This can reduce the likelihood of high or low areas when these materials are installed to create a sidewalk, driveway, or patio, for example.

The strike-off apparatus may be used primarily by the small to mid-sized concrete contractors who typically install concrete slabs or paved areas in size from about 2,000 to 20,000 square feet. This includes the "hand-rod" concrete contractors up to and including those who may already be using screeding machines, such as, for example, the Somero Copperhead and Copperhead XD line of Laser Screed products, which are commercially available from Somero Enterprises of Houghton, Mich., and which are described in U.S. patent application Ser. No. 10/728,620, filed Dec. 5, 2003, now U.S. Pat. No. 6,953,304; Ser. No. 10/266,305, filed Oct. 2, 2002, now U.S. Pat. No. 6,976,805; and Ser. No. 10/902,528, filed Jul. 29, 2004, now U.S. Pat. No. 7,121,762, which are hereby incorporated herein by reference. The lightweight raking device or strike-off device or apparatus or machine of the present invention is particularly suited for use at both over ground sites as well as on elevated deck surfaces, and may be implemented at other uncured concrete surfaces, such as interior floors, exterior slabs, roadways, ramps, parking areas or the like.

Figure 4:
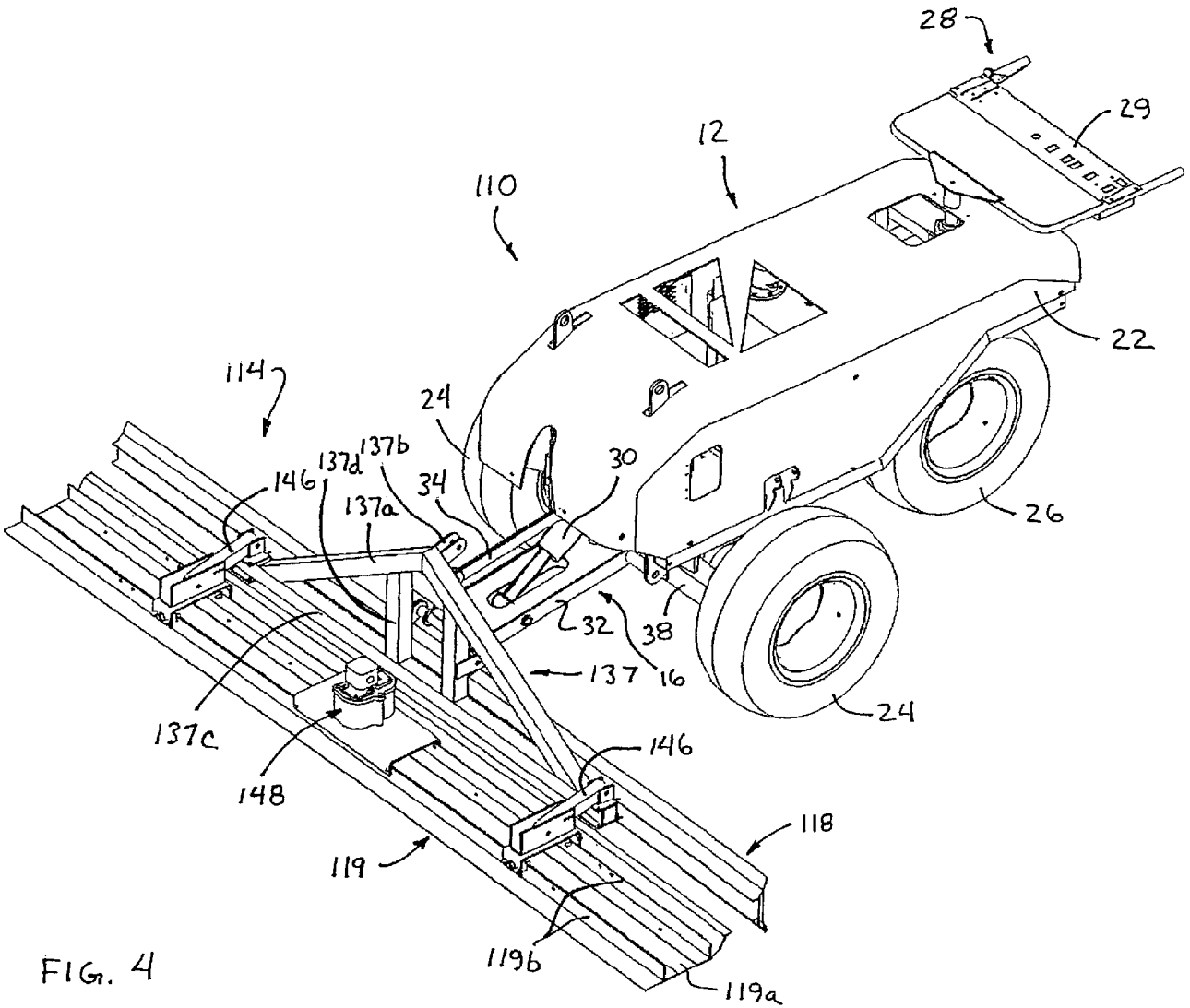
FIG. 4 is a perspective view of a powered screeding device in accordance with the present invention.

Optionally, and with reference to FIG. 4, the plow head assembly may be removed from the wheeled base unit 12 and a screeding attachment or screeding device 114 may be attached to the wheeled base unit to adapt the machine to be a screeding machine 110 for grading and screeding uncured concrete. The screeding attachment 114 includes a plow or strike-off member 118 and a vibrating member 119 mounted to and positioned rearwardly from the plow 118. The screeding attachment 114 is mounted to the rearward ends of the adjustment mechanism or linkage 16, such as at the rearward ends of the lift arm 32, such as in a similar manner as the plow head assembly discussed above. The screeding attachment 114 is configured to be moved over and along side forms or members positioned along the sides of an area or slab of uncured concrete, such as along the sides of poured concrete for a sidewalk or the like. The plow 118 may be set or positioned at a level above the forms while the vibrating member 119 may rest on the forms as the wheeled base unit 12 and screeding attachment 114 move along the forms and over and through the uncured concrete poured or placed between the forms, as discussed below.

Plow 118 of screeding attachment 114 may comprise any known plowing device or strike-off member, and may include a curved material engaging surface for plowing and carrying or moving the excess uncured concrete along the concrete area as the screeding device is moved along the forms. Plow 118 and screeding attachment 114 may be mounted to the wheeled base unit 112 via connection of a mounting frame 137 to the adjustment mechanism 16 of the wheeled base unit 12.

The mounting frame 137 of screeding attachment 114 includes a pair of cross members 137*a* that extend from a generally horizontal beam or member 137*c* along the rear of plow 118 and that extend upward and toward a center junction of the cross members 137*a*. A bracket or attachment plate 137*b* is positioned at the center junction of the cross members 137*a* for connecting an upper tie-rod or head support link 34 of the adjustment mechanism 16, while a pair of generally vertical members 137*d* extend between the cross members 137*a* and the generally horizontal member 137*c* for connection to the end of the lift arm 132 of adjustment mechanism 16. The cross members 137*a*, horizontal member 137*c* and vertical members 137*d* support the plow 118 and provide enhanced rigidity to the plow when the screeding attachment 114 is mounted to the adjustment mechanism 16 and the wheeled base unit 12.

Vibrating member 119 of screeding attachment is attached to the frame 137 of plow 118 and behind or at the rear of the plow 118, such as via a pair of mounting members or attachment members or links 146. Vibrating member 119 may comprise any known type of vibrating member, such as a vibrating member of the types described in U.S. patent application Ser. No. 10/728,620, filed Dec. 5, 2003, now U.S. Pat. No. 6,953,304; Ser. No. 10/266,305, filed Oct. 2, 2002, now U.S. Pat. No. 6,976,805; and Ser. No. 10/902,528, filed Jul. 29, 2004, now U.S. Pat. No. 7,121,762, which are hereby incorporated herein by reference. Vibrating member 119 includes a generally flat member with a generally planar, flat and smooth lower surface for engaging and working the uncured concrete surface. In the illustrated embodiment, vibrating member 119 extends along a longitudinal axis and includes a lower, generally flat planar portion 119*a* and a pair of generally vertical walls or rails 119*b* extending therealong to strengthen or stiffen the planar portion and limit or substantially preclude deflection of the member. Although shown and described as having a vibrating beam, the screeding device and/or screed head may alternately include any other type of concrete surface working device or member, such as a roller, a flat or contoured plate or the like, which engages and works the uncured concrete surface to flatten and/or smooth the concrete surface as the screeding device is moved over and along the uncured concrete.

Vibration of the vibrator member 119 is accomplished by a powered vibrator device or motor 148, which is powered by power source (not shown), such as a gasoline powered drive motor or engine, or a battery powered drive motor, or the like. As is known in the art, the vibrator device 148 includes a pair of eccentric weight shafts or members that are rotatably driven to cause vibration of the vibrating member 119 as the vibrating member is moved along and over the uncured concrete surface.

Optionally, and with reference to FIG. 5-10, the screeding attachment or device 114 may be mounted to an adjustment mechanism or linkage 116 that extends forwardly from a wheeled base unit or wheeled support 112 of a sidewalk screeding machine 110'. In the illustrated embodiment, wheeled unit 112 is a two-wheeled unit having a pair of wheels 124 that are rotatably driven to move the wheeled base unit over and through the uncured concrete surface. The wheeled unit may be similar to the types of wheeled base units described in U.S. patent application Ser. No. 10/728,620, filed Dec. 5, 2003, now U.S. Pat. No. 6,953,304; Ser. No. 10/266,305, filed Oct. 2, 2002, now U.S. Pat. No. 6,976,805; and Ser. No. 10/902,528, filed Jul. 29, 2004, now U.S. Pat. No. 7,121,762, which are hereby incorporated herein by reference. Because the wheeled base unit 112 is described in the above incorporated applications, a detailed discussion of the wheeled unit 112 will not be repeated herein. Suffice it to say that the wheeled unit may be driven or powered through the uncured concrete and steered and controlled by an operator via handle bars 128 and a control panel 129. Because there are only two wheels supporting the wheeled unit, the wheeled unit may be generally or substantially balanced about its axle and may be partially supported at its rearward end by the screeding device 114 during operation.

Figure 5:
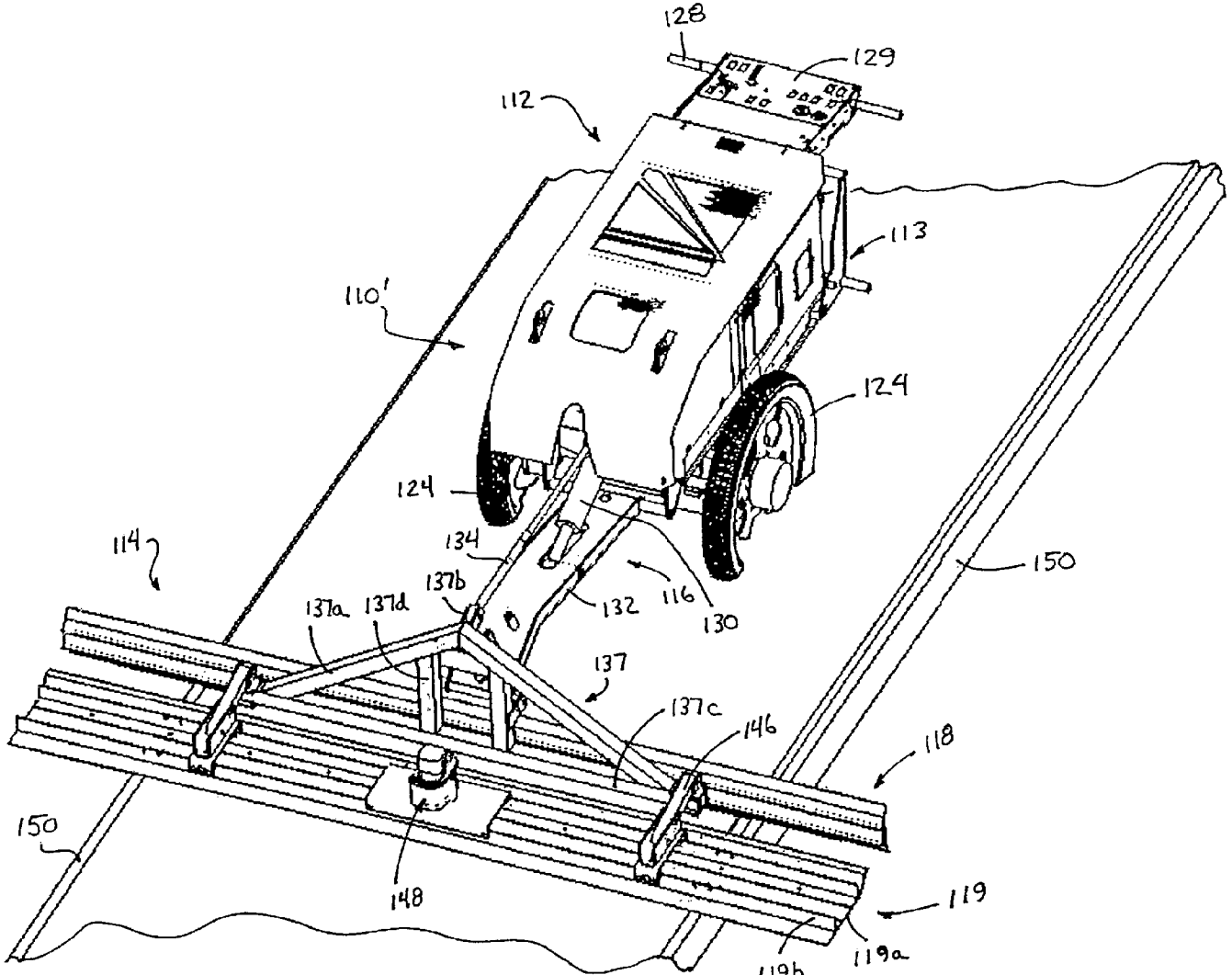
FIG. 5 is a perspective view of another powered screeding device in accordance with the present invention.
Figure 6:
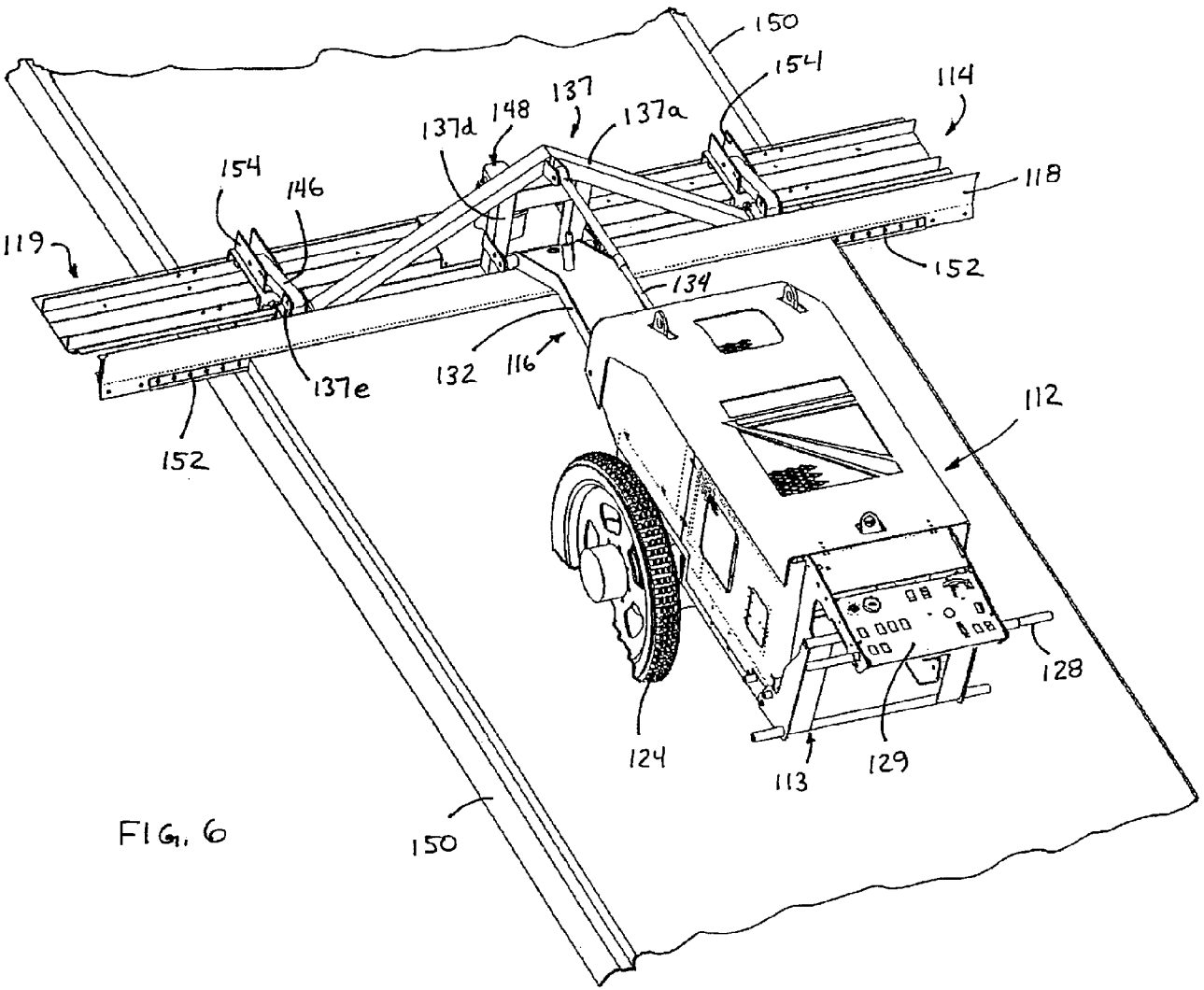
FIG. 6 is another perspective view of the powered screeding device of FIG. 5.
Figure 7:
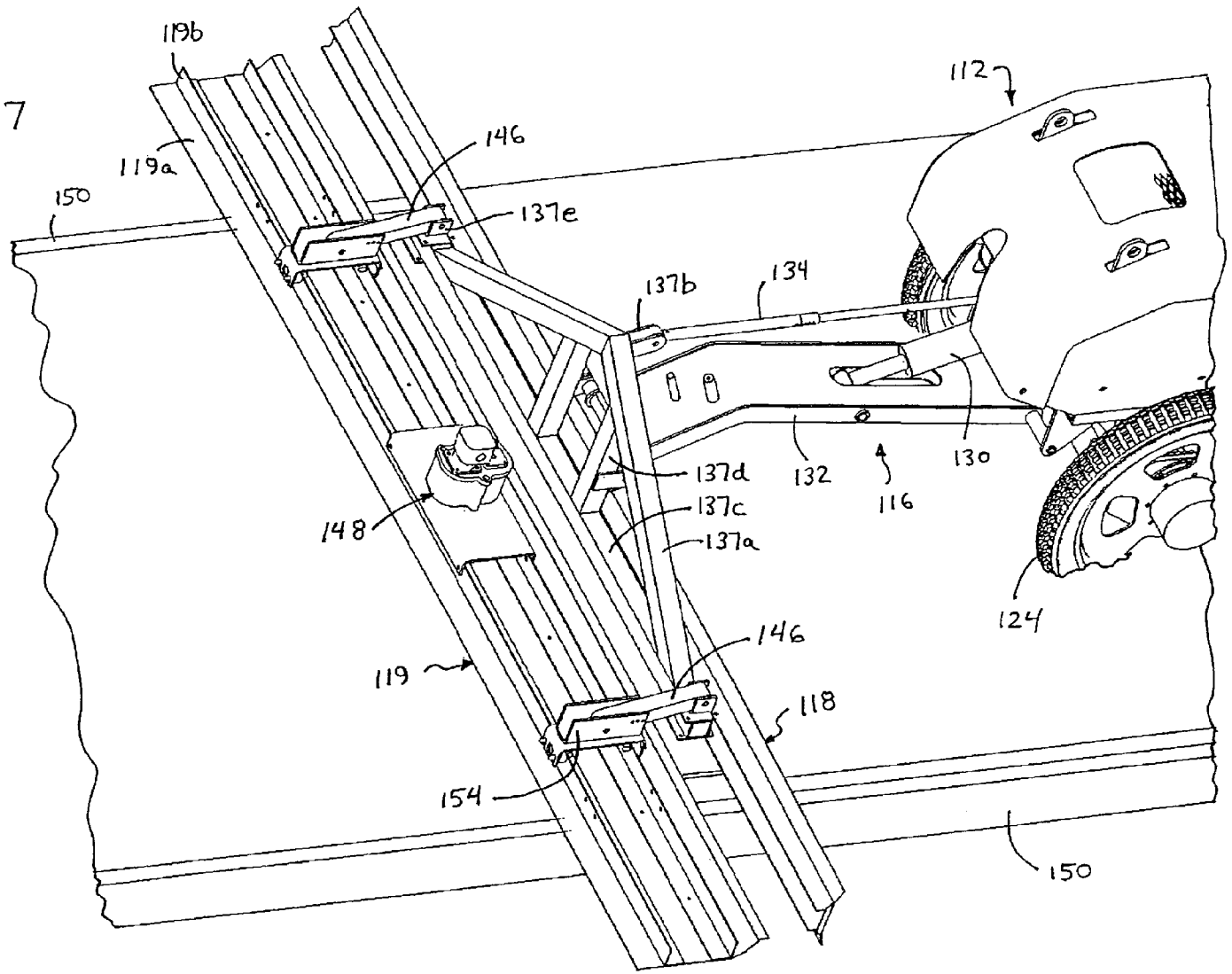
FIG. 7 is an enlarged perspective view of the screeding attachment of the powered screeding device of FIGS. 5 and 6.

The operator thus may walk ahead of the wheeled unit as the wheeled unit is driven or moved in the rearward direction and over and through the uncured concrete (with the wheels rolling along and over the subgrade surface beneath the poured/placed concrete) and the screeding attachment is pulled or dragged behind the wheeled unit to establish the grade of the concrete and vibrate and compact and screed the concrete, as discussed below. When a screeding pass is completed, the operator may push down on the handle bars 128 to raise the screeding device or attachment 114 above the concrete surface and to move the machine to another location. Optionally, the wheeled unit 112 may include a kick stand or support leg 113 at a rearward end (opposite to the screed head assembly or device) of the unit to support the rearward end of the unit when the screeding device is not being used. In the illustrated embodiment, the support leg 113 may be pivotally mounted at or near the rearward end of the wheeled unit and may be pivoted between a raised position (as shown in FIGS. 5 and 6) and a lowered position (not shown), where the support leg is pivoted downward to engage the ground and support the rearward end of the wheeled unit to limit or substantially preclude tipping of the unit forwardly when the screeding device is not in use.

The adjustment mechanism or linkage 116 of wheeled unit 112 may be similar to linkage 16, discussed above, and may include a lift arm 132, an upper tie-rod or head support link 134, and a hydraulic actuator or cylinder 130. Extension and retraction of actuator 130 causes the screeding attachment 114 to lower and raise, respectively, relative to wheeled unit 112 via pivotal movement of lift arm 132 and upper link 134 simultaneously relative to the rear end of wheeled unit 112. The movement of the linkages 116 relative to wheeled unit 112 and to the screeding attachment 114 provides generally vertical reciprocal movement of the screeding attachment relative to the wheeled unit, such that the plow 118 and vibrating member 119 may remain in generally the same orientation as the screeding attachment is raised or lowered relative to wheeled unit 112.

In the illustrated embodiment, the upper tie-rod 134 attaches to the bracket 137*b* at the center junction of the cross members 137*a* of the mounting frame 137, and may be adjusted to adjust the attack angle of the screeding device via pivoting the screeding device about the attachment pins at the end of the lift arm 132. As can be seen with reference to FIGS. 4 and 7, the upper tie-rods 34, 134 may be at a different level between the two illustrated types of wheeled base units, and thus may attach to the mounting frame 137 of the screeding attachment at different locations, depending on the particular application or base unit or support to which the screeding attachment is attached.

Figure 8:
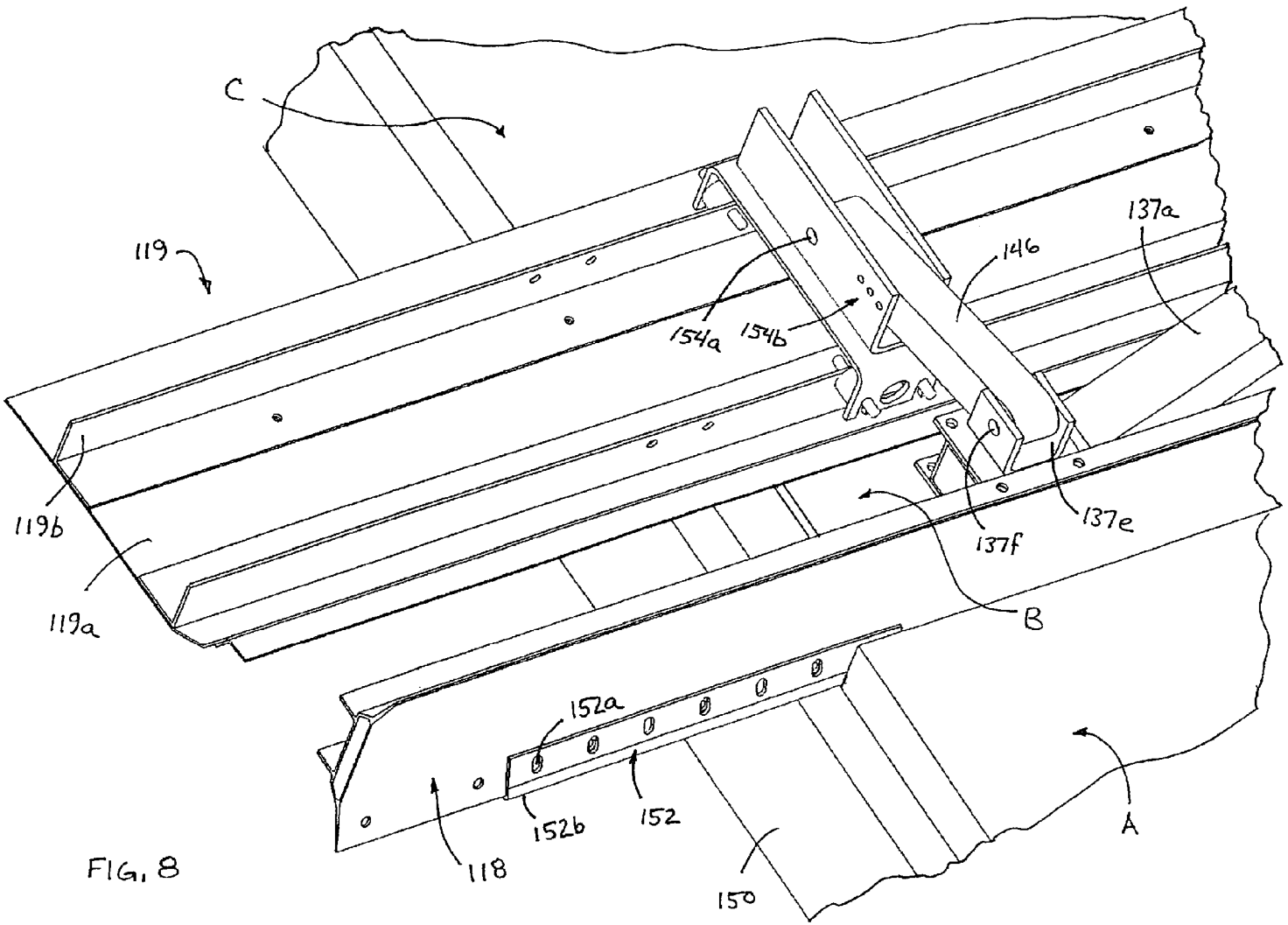
FIG. 8 is an enlarged perspective view of an end of the screeding attachment of FIG. 7.
Figure 9:
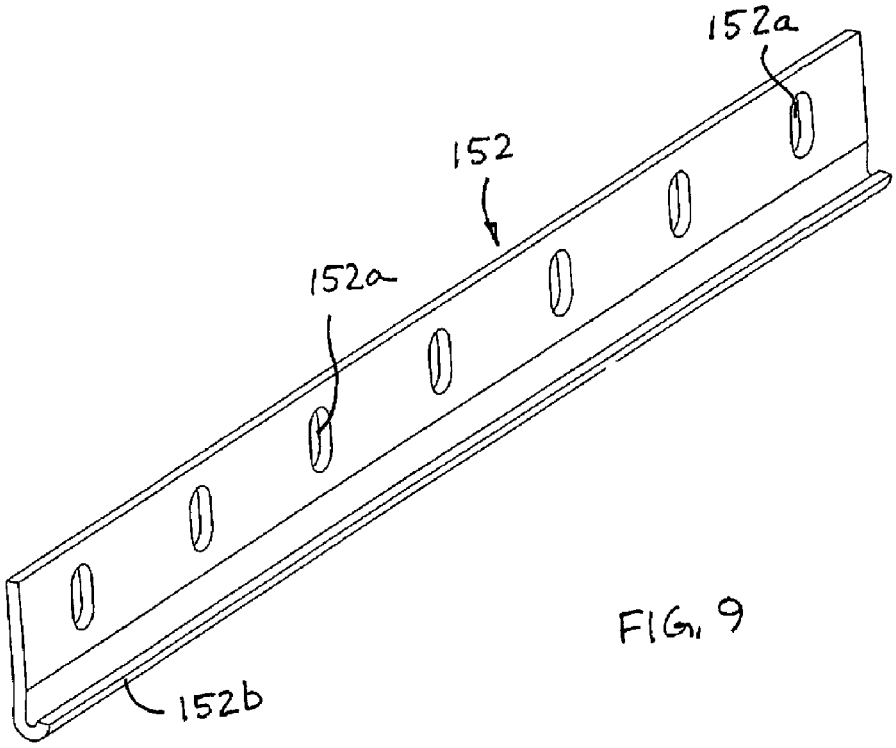
FIG. 9 is a perspective view of a spacing member of the screeding device of the present invention.

During operation, the wheeled unit 112 may be moved rearwardly over and through the uncured concrete, such as between a pair of forms or sidewalls 150 that contain the uncured concrete and define the sides or edges of the concrete slab, such as forms that may be placed along opposite sides of a sidewalk or the like during pouring and curing of the concrete sidewalk. As shown in FIGS. 6 and 8, the plow 118 may include a spacer member or element 152 positioned along a lower edge of the plow and at or toward the outer ends of the plow 118 for riding along and resting on the forms 150 as the screeding attachment is moved over and along the forms and uncured concrete. The spacer element 152 provides a spacing or raising function to space the lower edge of the plow above the level of the forms, such as about ¼ inch or thereabouts above the level of the forms, and above the level of the vibrating member, which rests on the forms and vibrates and screeds the concrete at the level of the upper surfaces of the forms.

The spacer member 152 may be attached or secured to the plow via fasteners or the like extending through apertures 152*a* (FIG. 9) in spacer member 152 and into or at least partially through the plow 118. As best seen with reference to FIGS. 8 and 9, spacer member 152 may include a curved lower lip 152*b* that may curve around or partially around the lower edge of the plow 118 when spacer member 152 is attached to the plow. The lower lip 152*b* thus provides a spacing function and raises the lower edge of the plow blade above the foul's 150 when the lip 152*b* rests on the forms. The curved lower lip 152*b* also provides a curved engaging surface at the plow to ride along the upper surface of the forms 150 and to limit or substantially preclude biting or cutting into the forms or catching burs or obstructions on the upper surfaces of the forms with the sharp lower edge of the plow.

Figure 10:
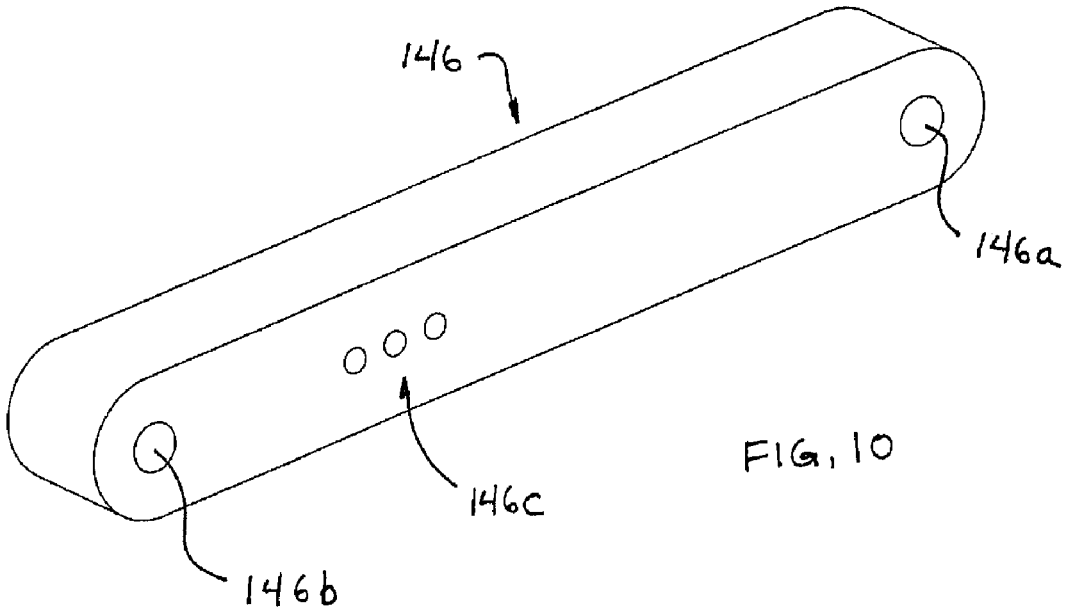
FIG. 10 is a perspective view of a mounting member of the screeding device of the present invention.
Figure 11:
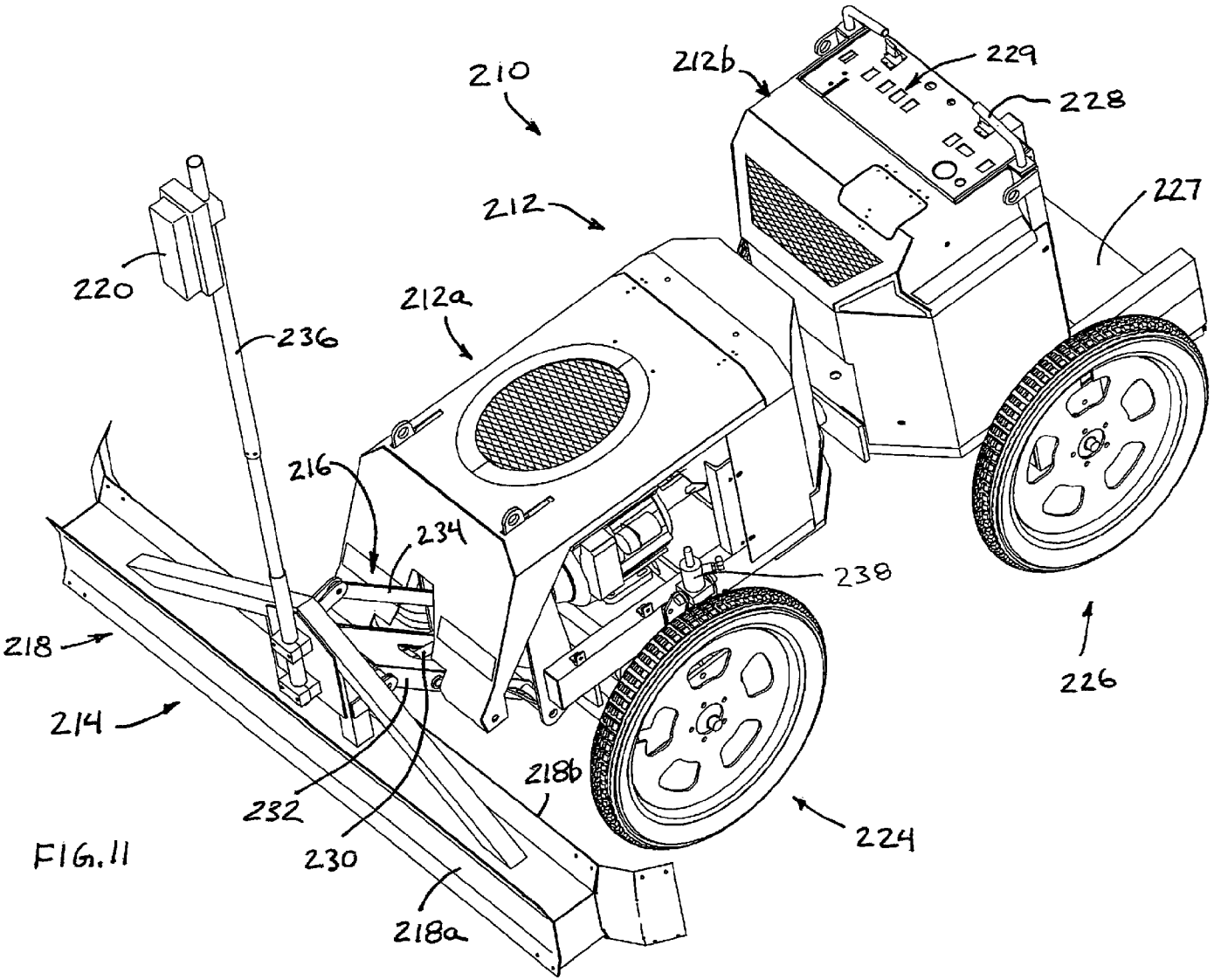
FIG. 11 is a perspective view of a powered strike-off device in accordance with the present invention.
Figure 12:
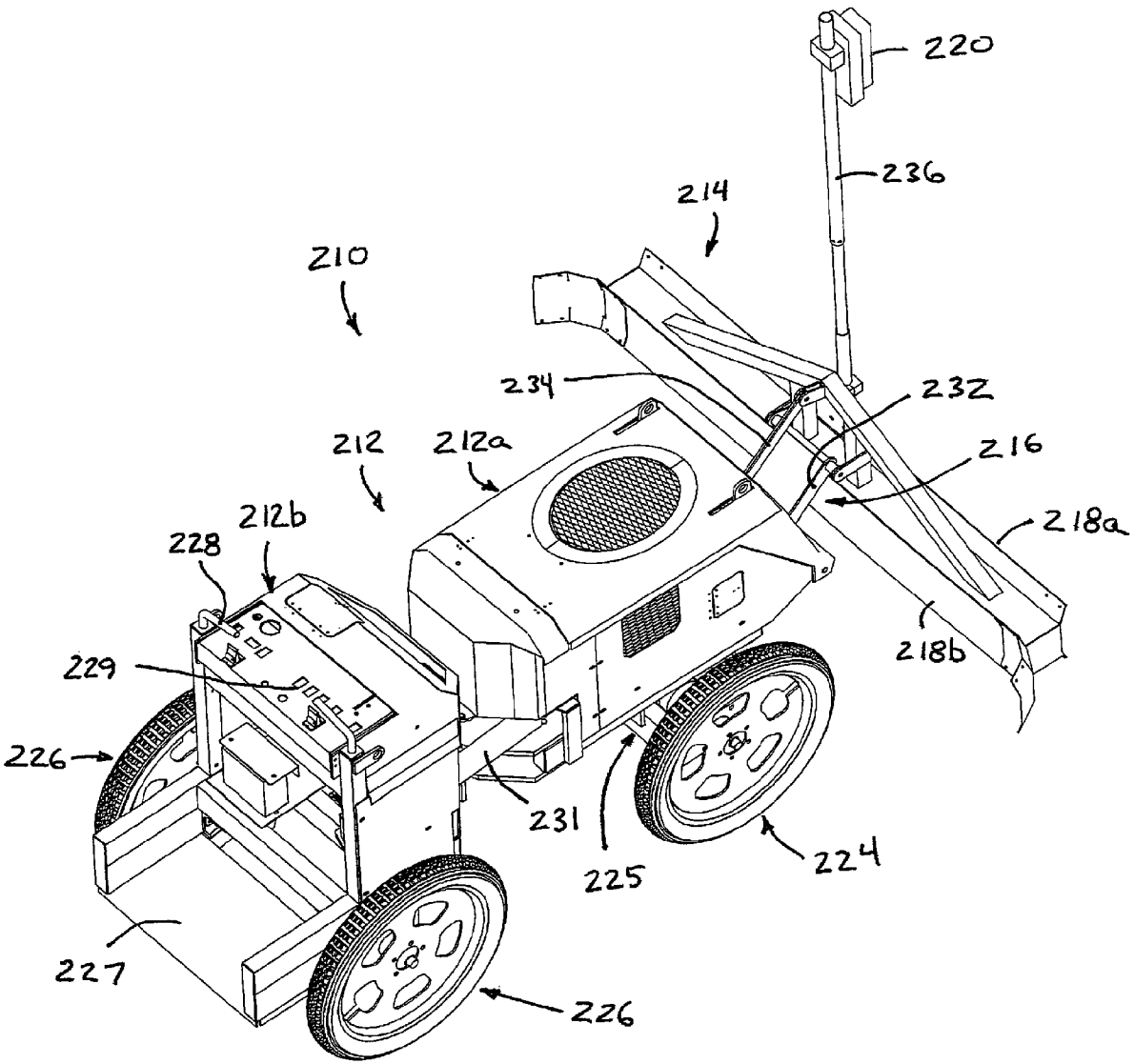
FIG. 12 is another perspective view of the powered strike-off device of FIG. 11.
Figure 13:
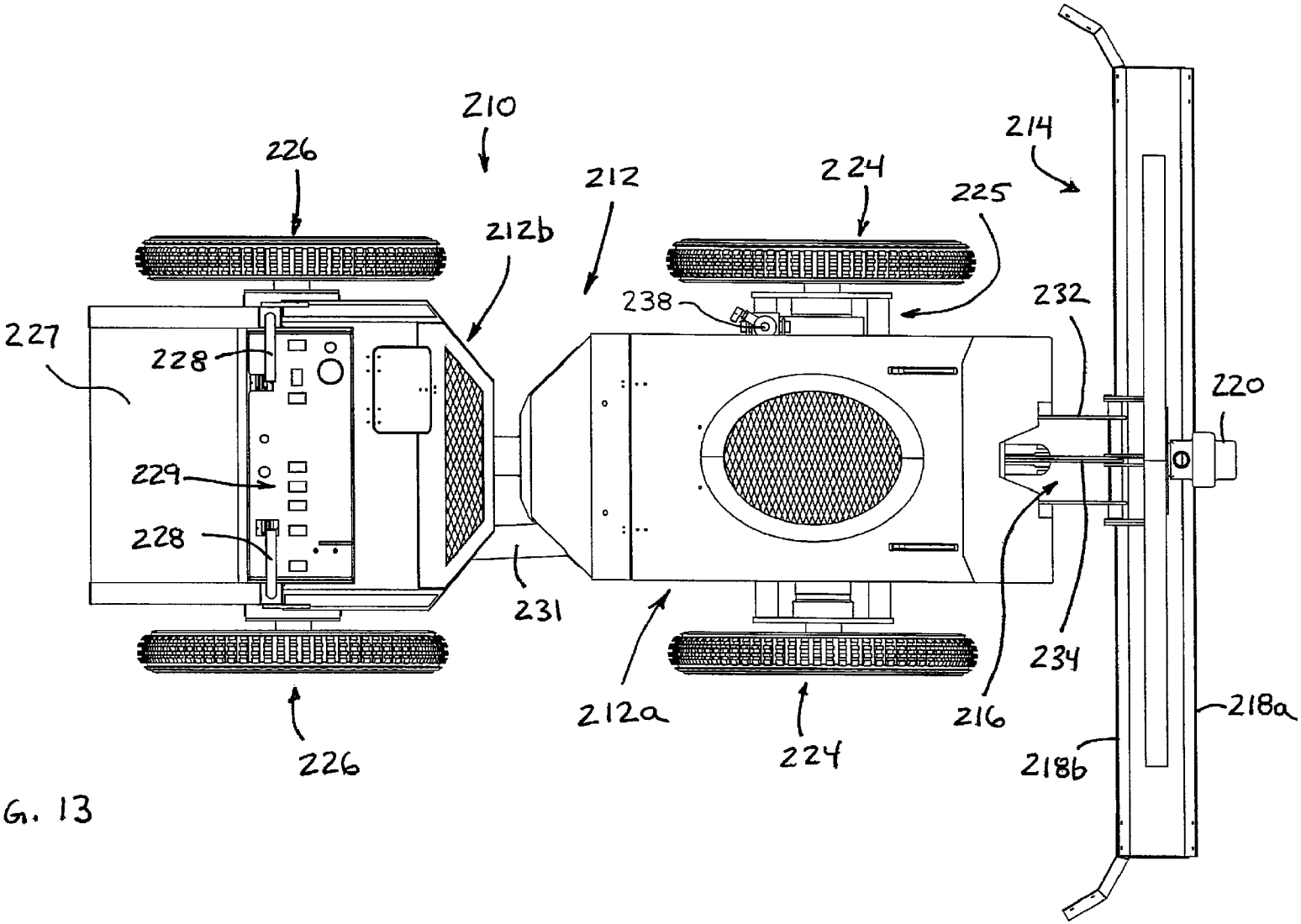
FIG. 13 is a top plan view of the powered strike-off device of FIGS. 11 and 12.

The vibrating member 119 is dragged or pulled behind the plow 118 while the wheeled unit 112 is moved forwardly over and through the uncured concrete via the attachment links 146 connecting or attaching the vibrating member to the plow. Each attachment link 146 may be connected between a bracket 137*e* of frame 137 of plow 118 and a bracket 154 at each side of vibrating member 119. The brackets 137*e*, 154 may comprise generally U-shaped brackets that receive a respective end of the link 146 therein. In the illustrated embodiment, and as shown in FIG. 10, the attachment link 146 is an elongated member that has mounting holes or apertures 146*a*, 146*b* at opposite ends of the link and multiple adjustment holes or apertures 146*c*. Attachment link 146 pivotally mounts to the bracket 137*e* at plow 118 via a mounting pin or the like through an opening or aperture 137*f* (FIG. 8) in the bracket 137*e* and through aperture 146*a*, such that the attachment link may pivot about the mounting pin 156 when attached thereto. The other end of the attachment link 146 may be attached to the bracket 154 at the vibrating member 119 via a mounting pin or the like inserted through an opening 154*a* (FIG. 8) in the bracket 154 and aperture 146*b* in attachment link 146.

Optionally, the attachment link 146 may be secured relative to the vibrating member to retain the vibrating member at a desired attack angle as the vibrating member is dragged or pulled along the forms. The attachment link may be pivoted about the pin through the apertures 154*a* and 146*b* to adjust the attack angle of the vibrating member until one of the multiple apertures or openings 146*c* generally aligns with a corresponding one of multiple apertures 154*b* (FIG. 8) in bracket 154. When a desired set of openings are aligned (so that the vibrating member is at a desired attack angle), a pin may be inserted through the aligned openings to substantially secure or fix the mounting link 146 relative to the bracket 154 and vibrating member 119. The attachment link thus may be pivoted and the pin may be inserted through a selected set of aligned openings to set the desired or appropriate attack angle of the vibrating member relative to the plow.

During operation of the sidewalk screeding machine, the wheeled unit is moved or driven rearwardly and over and through the uncured concrete and between the forms to move the screeding attachment along the forms and over the uncured concrete placed between the forms. The plow functions to cut and establish the concrete grade to a level above the level of the forms, while the vibrating member is dragged behind the plow and rests on and moves along the upper surfaces of the forms. Because the attachment links are pivotally attached to the rear of the plow, the vibrating member may freely float relative to the plow and thus may rest on the forms so that the vibrating member is generally at the elevation of the forms and at a level slightly below the level of the concrete grade established by the plow 118.

As shown in FIG. 8, the uncured concrete may be placed at an initial or placed depth or level A in front of the plow, and the plow may remove some of the excess uncured concrete so that the uncured concrete is at a pre-screeding level B after the plow has passed over and through the uncured concrete. The vibrating member is moved over the uncured concrete behind the plow and vibrates and compacts and screeds and finishes the uncured concrete to its desired finished level C, which is generally level with the upper surfaces of the forms 150 and below the pre-screeding level B established by the plow. The vibrating member thus vibrates and compacts the uncured concrete to the lower desired level or grade that is set by the forms 150. The sidewalk screeding machine thus may establish a desired initial grade with the plow and provide a slight amount of excess uncured concrete above the desired final grade for the vibrating member to compact and vibrate to the desired final grade. The sidewalk screeding machine thus may screed the concrete to an enhanced finished surface at the desired grade and without the use of an automated laser control system having a laser receiver and laser plane generating device or the like.

Referring now to FIGS. 11-14, an articulated power rake machine or device or apparatus 210 includes an articulatable wheeled base 212, which is supported by four rubber-tired wheels, two front wheels 224 at the front and two rear wheels 226 at the rear, and which supports a plow head assembly 214. Power may be provided by any power means, such as a gasoline powered engine or the like, such as, for example, a thirteen horsepower (or other power) gasoline engine, or other power source or means, such as described above. The machine comprises an articulated main support frame 212 having a front frame portion 212*a* (supported by front wheels and tires 224) and a rear frame portion 212*b* (supported by rear wheels and tires 226) and various components, including, for example, a supply of hydraulic oil in a reservoir, hydraulic pump, control valves, hydraulic pressure lines, and an electrical system including a battery and charging system.

In the illustrated embodiment, the plow head assembly 214 is attached to the front frame portion of the machine through a mechanical linkage 216 and a hydraulic actuator, such as in a similar manner as described above. The height or elevation of the plow blade 218 is controlled by an automated laser control system having a single laser receiver 220 attached to the plow by a vertical mast 236. A laser transmitter (not shown) stationed away from the machine provides or generates a laser reference plane for the machine's automated laser control system.

Figure 14:
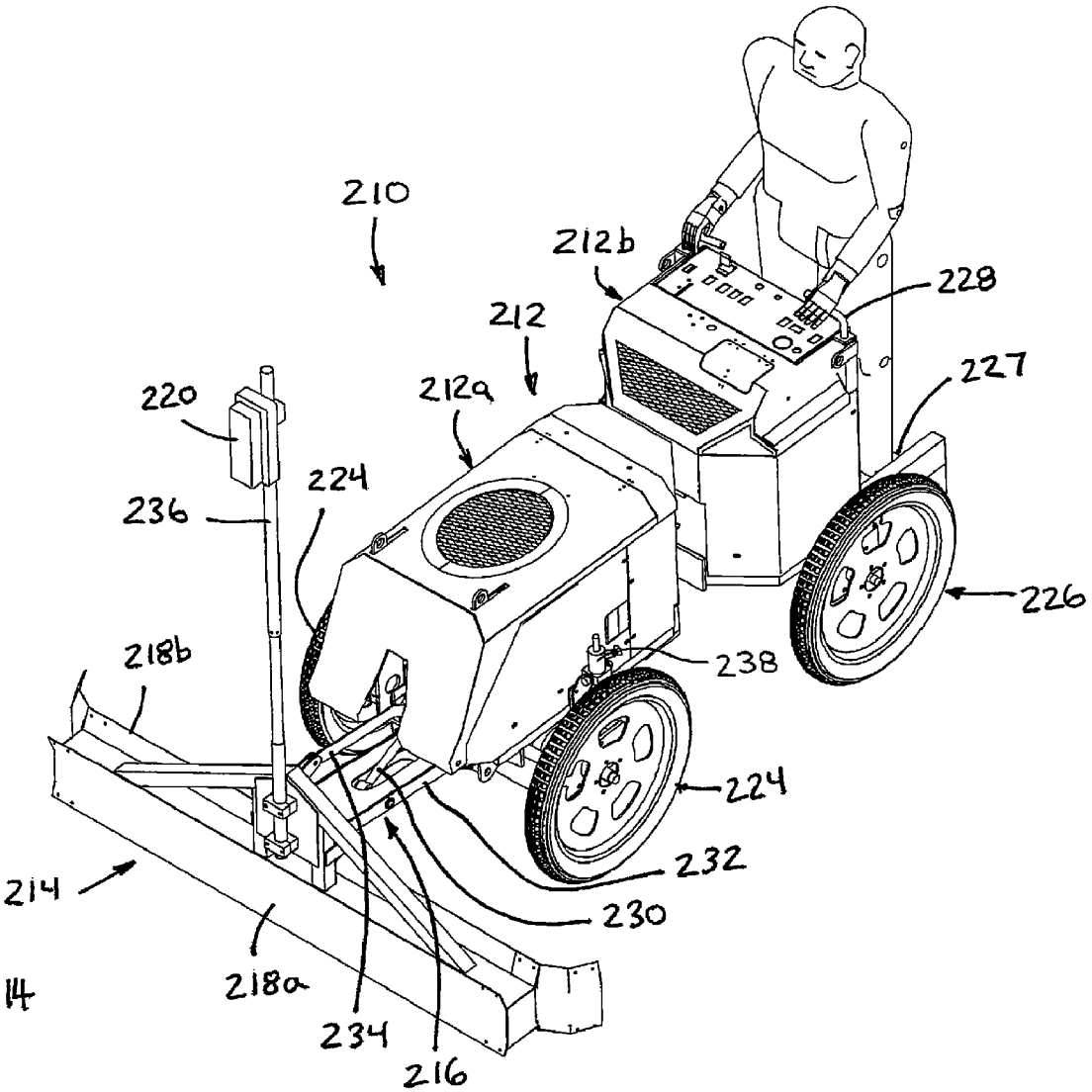
FIG. 14 is another perspective view of the powered strike-off device, shown with an operator standing on the operator's platform.

As shown in FIG. 14, the machine operator may stand on a platform 227 attached to the rear frame portion 212*b* of the machine. The operator controls propulsion speed and direction and steers the machine via user activated inputs, such as, for example, thumb-activated controls 229 just below the handlebars 228. The handle bars are fixed to the rear frame portion 212*b* of the machine and may include foam-padded grips for operator comfort. Steering may be accomplished through a double-acting hydraulic cylinder 231 (FIGS. 12 and 13) at a side of the machine. The steering cylinder 231 is attached at the ends to both the front and rear frame portions 212*a*, 212*b*. Extension and retraction of the steering cylinder 231 thus provides a moment force that acts about the vertical axis of the hinged articulated frame to steer the machine in either the left or right direction.

Figure 15:
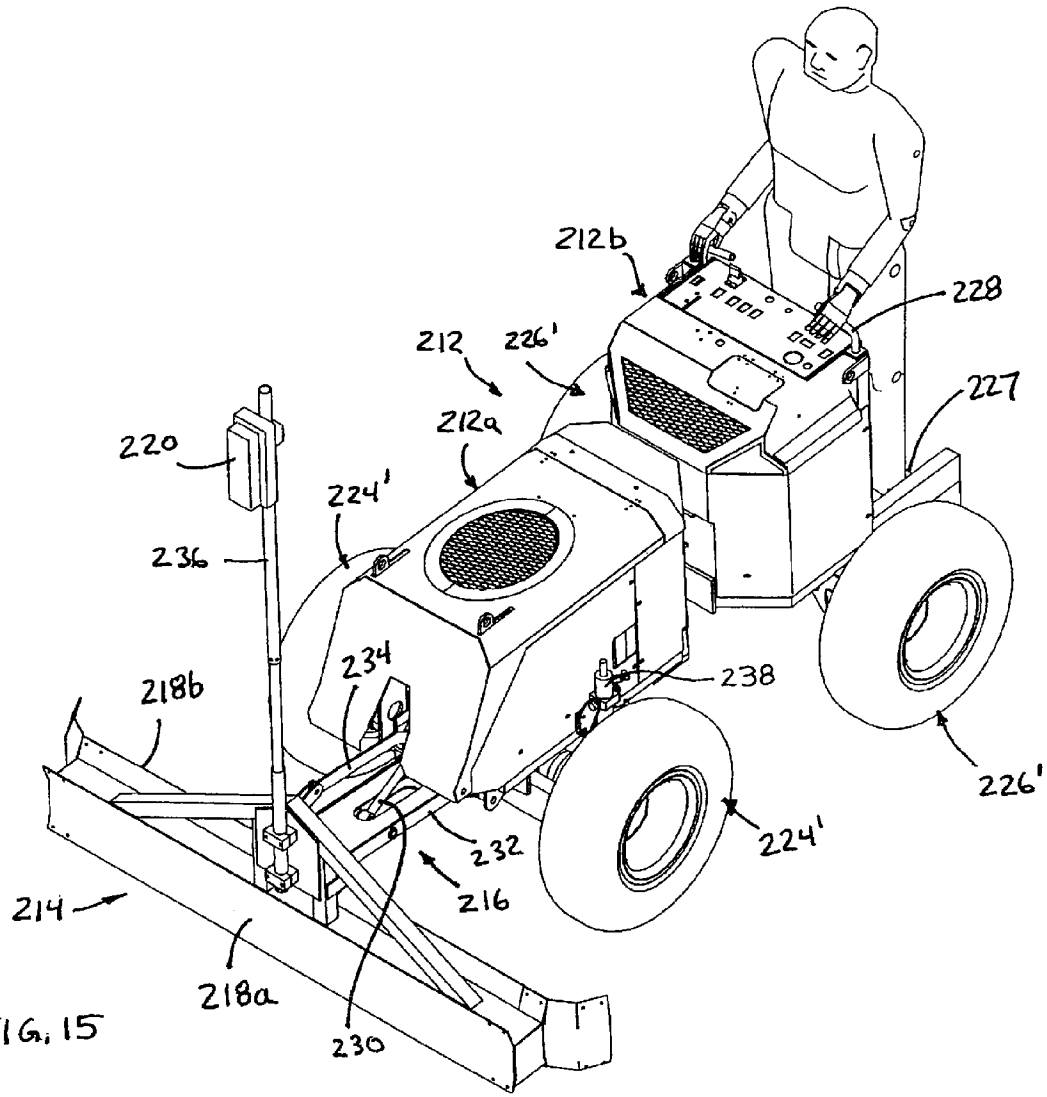
FIG. 15 is a perspective view of the powered strike-off device of the present invention, shown with larger width tires.

Desirably, each of the four wheels may be driven by hydraulic motors providing a four-wheel drive propulsion system. Hydraulically released brakes may be used on preferably two or more of the four wheels. The wheels and tires may be optionally selected for particular site conditions. For example, narrow wheels and tires 224, 226 (FIGS. 11-14) may be used primarily for conditions where the machine will be driven through uncured concrete on firm or otherwise compacted subgrade materials. Optionally, and with reference to FIG. 15, wider wheels and tires 224', 226' may be fitted onto the machine for use on soft or sandy subgrades or in uncured concrete placed upon elevated metal decks. The wider tires may provide greater floatation on soft subgrade materials and improved wheel contact and load distribution on corrugated metal decking materials and the like.

The plow head assembly 214 is supported by a lift arm 232, upper tie-rod or head support link 234, and a hydraulic actuator or cylinder 230 forming a vertically movable mechanical linkage, such as described above. The plow head assembly consists of a forward plow 218*a* and a rearward plow 218*b*. A laser receiver 220 is attached to a mast 236 located in the middle of the plow 218. The plow head is able to either push or pull loose material such as freshly poured concrete, sand, dirt, or gravel. A standard laser control system, such as a laser control system provided by Trimble Navigation and comprising the GCR Laser Control System package (or other suitable laser control system or the like), is adapted to the machine to actively control the elevation of the plow head. The laser control system controls a hydraulic valve which in turn controls the position of the hydraulic actuator at the plow with respect to the laser reference plane while the machine is in operation.

In addition to providing propulsion power to drive the machine and provide powered steering, the front wheels 224 and axle assembly or subframe 225 of front frame portion 212*a* may also have the ability to oscillate or tilt the machine and plow head side to side with respect to the horizontal. In the illustrated embodiment, the front wheels are attached to a single axle member or axle assembly or subframe 225, while the frame portion 212*a* is pivotally mounted to the axle assembly 225 and is pivotable about a generally horizontal axis that is generally parallel to the ground and that extends generally parallel to the direction of travel of the machine as it moves during operation. Side-to-side tilting or oscillation of the machine (such as the front frame portion 212*a* and plow head) relative to the axle assembly and wheels may be controlled by an actuator or hydraulic cylinder 238 (or other actuating device) with a first end of the cylinder or actuator attached to the frame portion 212*a* of the machine and a second or opposite end attached to the axle or subframe 225. In such an application, the hydraulic actuator may comprise a double-rod cylinder having a single piston, whereby the amount of hydraulic oil required for a given displacement in either direction may be substantially the same. The operator thus may manually control the amount of tilt of the machine and plow head by a control switch or lever or input at the user controls or handlebars. This allows the machine and operator to adjust and maintain a generally horizontal position of the plow head with respect to the desired grade due as the machine (such as one or both tires of the front portion of the machine) encounters variations in the subgrade that may cause the machine to tip or tilt toward either side.

Optionally, the horizontal leveling of the plow may be automatically controlled by the input signal of a left-right horizontal level sensor or cross slope level sensor mounted to or at the forward frame portion of the machine During most machine operating mode conditions, the operator may manually control the machine speed, steering of the machine, and the forward and reverse direction of travel, while the side-to-side or horizontal leveling position of the plow head is controlled by the left-right leveling sensor and actuator. The elevation of the plow head may be automatically controlled by an input signal from the laser receiver of the laser control system, as discussed above.

A further aspect of the machine's control system includes an "auto rake" or "auto raise" controller or control system or other control means that is operable to automatically raise the plow head assembly (including the plow blade) at the end of a material leveling or raking or grade establishing pass. For example, as the machine is being driven in the "reverse" travel direction through uncured concrete, the plow is engaged in striking-off and/or leveling of the , excess uncured concrete material to the desired grade. In this mode of operation, the height of the plow head is automatically controlled to the desired elevation by height correction signals from the laser receiver (as the laser receiver receives or detects the laser signal or plane transmitted by the laser plane transmitter or generator).

Figure 16:
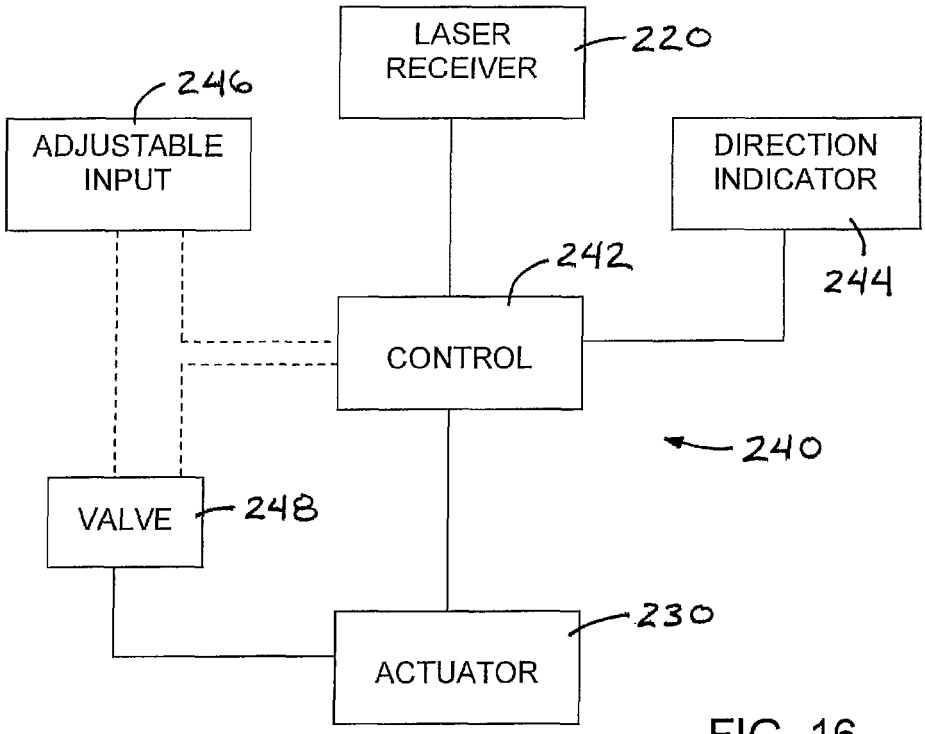
FIG. 16 is a block diagram of a control system useful with the strike-off device or screeding device of the present invention.

As shown in FIG. 16, a control system 240 of the machine may include a control or controller 242, which receives signals from the laser receiver 220, and which may control the elevation actuator or cylinder 230 in response to the signals from the laser receiver. The controller 242 also receives a signal from a direction switch or indicator 244 (or wheel sensor or other direction determining or direction indicating device or means) that is indicative of the direction of travel of the machine. For example, the controller may receive a signal from the direction switch that is indicative of the machine traveling in the reverse direction (the normal direction of travel of the machine when it is used for plowing or raking or screeding the uncured concrete), and may thus control the elevation actuator in response to the correction signals from the laser receiver so that the plow is maintained at the desired level or grade as the machine is moved in the reverse direction over and along the concrete.

At the end of a material raking or leveling pass, the operator may stop the machine and may then select the "forward" travel direction position of the propulsion direction control. Stopping the machine and/or election of the "forward" travel position of the propulsion direction control may automatically provide a signal (from the direction switch or direction indicating device or wheel encoder or the like) to the controller, whereby the controller may actuate or control the lift actuator or cylinder (such as to a hydraulic raise valve of the plow lift cylinder) to raise the plow blade out of and away from the uncured concrete material in response to the signal. During this part of the operation, any "lower" signal from the laser receiver (as the laser receiver is also raised and thus is raised above the laser reference plane) is temporarily blocked (or the laser receiver is deactivated or its signal is otherwise effectively ignored by the controller) to prevent the plow from being automatically lowered toward the correct grade height. Once the plow and laser receiver are raised so that the laser receiver is out of the sensing range of the laser receiver, blocking of the corrections signal from the laser receiver is no longer necessary.

At the fully raised position, the plow head may be brought to a point where the plow lift arm or lifting mechanism engages a limit switch, which may limit further raising of the plow head. At this position, the plow remains at rest in the raised position (and may be secured or retained in the raised position) as the machine is driven through the uncured concrete by the operator in the forward direction. During this step of the process, the plow is not engaged in striking-off and leveling the material. At the end of the forward travel pass, the machine's travel may again be stopped by the operator. The operator may again select the "reverse" position of the propulsion control and may also select a switch to once again lower the plow head for engagement with the concrete (optionally, the plow head may be automatically lowered in response to selection of the reverse position or movement of the machine in the reverse direction or in response to the stopping of the wheeled device after traveling in the forward direction). As the plow is brought toward the desired grade, the laser control system again assumes control and establishes and maintains the cutting edge of the plow at the correct elevation while the operator drives the machine in the reverse travel direction. This semi-automated "auto rake" or "auto raise" process is repeated as many times as is necessary to accomplish the desired strike-off and levelness of the concrete prior to the finish screeding operations. The "auto rake" or "auto raise" system thus provides the operator with an option for reducing the number of necessary control inputs while operating the machine. This can help reduce operator fatigue and increase overall machine productivity.

A further aspect of the machine's control system may be referred to as an "auto drag" function. The "auto drag" function is provided by an adjustable user input or relief valve input 246 (FIG. 16) that in turn controls or adjusts the setting of a pressure limiting control valve 248 located within the plow raise-lower hydraulic circuit (such as via the controller 242 or other controller of the machine or control system). The adjustable relief valve may be located within reach of the operator on the operator's control console. The actual pressure limiting control valve may be located within the supply pressure line of the plow lift cylinder circuit. By rotating the adjustable knob on the operator's control console, the operator can adjustably limit the maximum hydraulic pressure available to lower or otherwise drive the plow assembly in a downward direction. This effectively adjusts and limits the downward force available at the plow to fully engage the material to be power raked. As shown in FIG. 16, the control valve 248 may be controlled directly by the user input 246 or may be controlled by the controller 242 (which may receive a signal or input from the user input 246) to adjust the down pressure applied by the plow assembly at the concrete surface.

For example, when an excessive amount of loose subgrade material or uncured concrete is encountered at the plow while driving the machine in the reverse travel direction, the operator may elect to reduce the downward force of the plow by adjusting the "auto drag" setting. By reducing the "auto drag" setting, the plow will tend to rise up and disengage a portion of material whenever it encounters an excessive load of material to be moved. Thus, the load on the machine is reduced to a level that will more closely match the machine's tractive effort and the available engine horsepower under the given conditions. It is then possible to maximize the machine's productivity without actually stalling the hydraulic motors that drive the propulsion wheels, or cause the wheels themselves to spin from a loss of traction at high levels of tractive effort. Therefore, the "auto drag" feature provides the operator with the ability to readily adjust the degree of engagement of the material with the plow and promote the highest available level of productivity of the machine Optionally, the down pressure of the plow may be automatically adjusted or reduced by a control or controller or control system of the machine in response to a detection of slippage of the wheels/tires at the subgrade or other input (such as a resistance measurement of the resistance against rearward movement of the plow against material that has accumulated at the plow or the like) that may be indicative of excess material at the plow that limits the rearward progress of the concrete working or processing machine or device.

Figure 17:
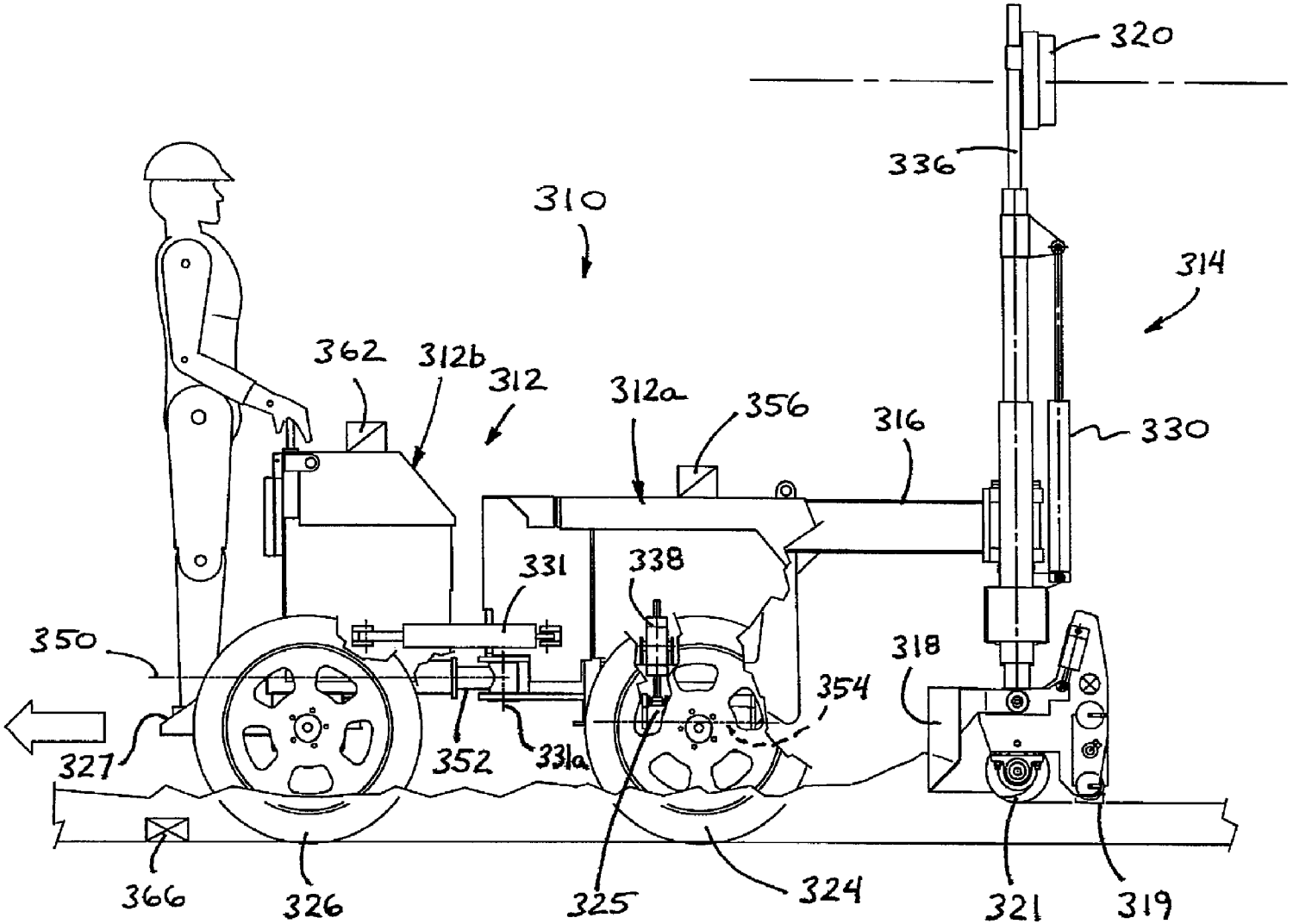
FIG. 17 is a side elevation of a powered screeding device in accordance with the present invention.

Referring now to FIG. 17, an articulated powered rake or plow or screeding or concrete working or processing machine or device or apparatus 310 includes an articulatable wheeled base 312, which is supported by four rubber-tired wheels, two front wheels 324 at the front frame portion 312*a* and two rear wheels 326 at the rear frame portion 312*b*. The front frame portion 312*a* supports a plow and/or screed head assembly 314. The wheeled support or base may be substantially similar to the wheeled supports described above, such that a detailed description of the wheeled supports will not be repeated herein.

In the illustrated embodiment, the head assembly 314 comprises a screed head assembly, having a plow member 318 and a vibrating member 319. Optionally, and as shown in FIG. 17, the screed head assembly 314 may include a material moving device or auger 321, whereby the plow member may roughly establish the grade of the concrete and the auger may further establish the desired grade of the concrete before the vibrating member vibrates, compacts and smoothes the concrete at the desired grade. The screed head may utilize aspects similar to those described in U.S. Pat. Nos. 4,655,633; 4,930,935; 6,129,481; 6,152,647; 6,183,160; 6,588,976; and/or 6,623,208; and/or U.S. patent application Ser. No. 10/728,620, filed Dec. 5, 2003, now U.S. Pat. No. 6,953,304; Ser. No. 10/266,305, filed Oct. 2, 2002, now U.S. Pat. No. 6,976,805; Ser. No. 10/902,528, filed Jul. 29, 2004, now U.S. Pat. No. 7,121,762; and/or Ser. No. 10/804,325, filed Mar. 19, 2004, now U.S. Pat. No. 7,044,681, which are hereby incorporated herein by reference. In the illustrated embodiment, screed head assembly 314 is attached to a substantially rigid boom 316 extending from the front frame portion 312*a* of the wheeled support unit 312. The height or elevation of the plow blade 318, auger 321 and vibrating member 319 is adjusted via at least one elevation actuator or hydraulic cylinder 330, which is controlled by an automated laser control system having a laser receiver 320 attached to the plow by a vertical mast 336. A laser transmitter (not shown) stationed away from the machine provides or generates a laser reference plane for the machine's automated laser control system.

As shown in FIG, 17, the machine operator may stand on a platform 327 attached to the rear frame portion 312*b* of the wheeled support 312. The operator controls propulsion speed and direction and steers the machine via user activated inputs, such as in a similar manner as described above. Steering may be accomplished through a double-acting hydraulic cylinder 331 at or toward a side of the machine. The steering cylinder 331 is attached at the ends to both the front and rear frame portions 312*a*, 312*b*. Extension and retraction of the steering cylinder 331 thus provides a moment force that acts about the vertical axis 331*a* of the hinged articulated frame to steer the machine in either the left or right direction. Optionally, each of the rear or front wheels or each of all four wheels of the wheeled support may be driven by hydraulic motors providing a two-wheel or four-wheel drive propulsion system.

In the illustrated embodiment, the rear frame portion 312*b* may pivot about its longitudinal axis 350 relative to a mounting or connecting arm or member 352 that pivotally mounts to front frame portion 312*a* and that pivots relative to front frame portion 312*a* about the generally vertical pivot axis 331*a* of the wheeled support 312. For example, the rear frame portion may rotatably receive a generally cylindrical connecting arm within a generally cylindrical receiving member, where the connecting arm may rotate or pivot within the receiving member to allow for pivoting or tilting of the rear frame portion relative to the connecting arm and the front frame portion. The rear frame portion 312*b* thus may pivot about two axes relative to the front frame portion. Optionally, the rear frame portion may pivotally attach to the front frame portion via other pivotal means, such as a ball and socket type arrangement or universal joint or a flexible connecting member or the like, in order to provide the desired degree of freedom between the front and rear frame portions.

As can be seen in FIG. 17, the front wheels 324 and axle assembly or subframe 325 at front frame portion 312*a* may have the ability to oscillate or tilt the machine and plow head about a longitudinal pivot axis 354 so as to pivot side-to-side with respect to the horizontal. In the illustrated embodiment, the front wheels are attached to the axle or subframe 325, and the front frame portion 312*a* is pivotally mounted to the axle or subframe and is pivotable about longitudinal pivot axis 354. Side-to-side tilting or oscillation of the front frame portion (and the screed head assembly) may be controlled by an actuator or hydraulic cylinder 338 (or other actuating device) with a first end of the cylinder or actuator attached to the frame portion 312*a* of the machine and a second or opposite end attached to the axle or subframe 325, such as described above.

As shown in FIG. 17, front frame portion 312*a* may include a front level sensor or tilt sensor or cross slope level sensor 356 (which may be mounted at the frame portion 312*a*, as shown, or which may be mounted at the screed head assembly). The front level sensor 356 is operable to detect a side-to-side tilt or pivotal movement of the front frame portion (or the screed head assembly) about the longitudinal axis 354. A control 358 (FIG. 18) of a control system 360 may be responsive to a signal from the front level sensor 356 and may be operable to actuate or adjust or control actuator 338 to control the tilt of the front frame portion 312*a* relative to the axle assembly 325 and front wheels 324, so as to substantially maintain the screed head assembly at a level or desired orientation, even when the wheels and axle assembly may tilt as the wheels encounter bumps or surface irregularities or uneven terrain as the machine is moved rearward over and through the concrete and generally along and above the subgrade surface.

The control system of the concrete screeding or working device may be operable to detect a bump or surface irregularity on or at the subgrade surface as it is encountered by the rear wheels (such as via a bump detecting device or system or the like) and may reduce or decrease the speed of the machine (by reducing or controlling an output of a drive system 364 of the machine) in anticipation of the front wheels encountering the bump, so that the control 358 and actuator 338 may more readily adapt to and accommodate the surface irregularity when the front wheels subsequently encounter the surface irregularity at the reduced rate of travel. In the illustrated embodiment, the bump detecting system comprises a rear level sensor or tilt sensor or cross slope level sensor 362, which is operable to detect a side-to-side tilt or pivotal movement of the rear frame portion 312*b* about its longitudinal axis 350, such as in a similar manner as the front level sensor 356.

Figure 18:
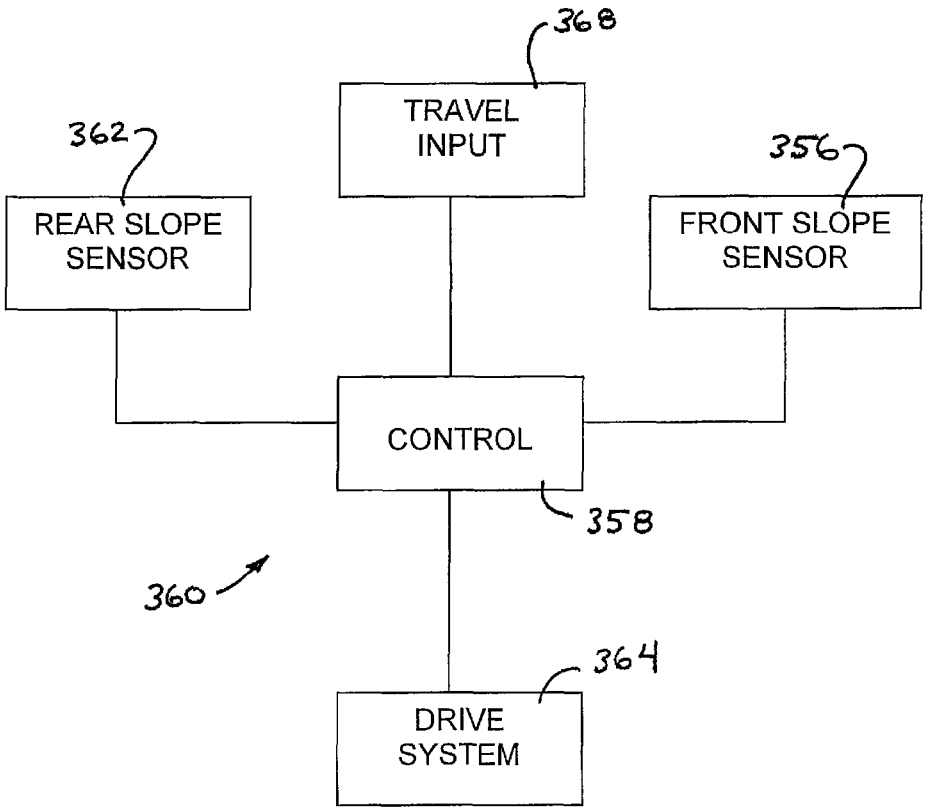
FIG. 18 is a block diagram of a control system useful with the strike-off device or screeding device of the present invention.

As shown in FIG. 18, control or controller 358 of control system 360 may receive a signal from rear level sensor 362 to detect when one of the rear wheels 326 encounters an object or bump or uneven terrain or surface irregularity (such as object 366 in FIG. 17) as the wheeled support is traveling in the rearward direction through the concrete. In response to a signal from rear level sensor 362 that is indicative of a sufficient or threshold bump or surface irregularity, control 358 reduces the drive speed of the wheels so as to reduce the rearward speed of travel of the wheeled support unit so that the wheeled support unit will be traveling at a slower or reduced rate when the front wheels encounter the detected bump or surface irregularity.

The control 358 may also receive an input signal from a speed or distance or travel indicating device or indicator 368 (which may comprise a wheel encoder, a wheel speed sensor, a distance sensor and/or a timing device and/or the like). The control 358 thus may determine when the front wheels 324 have passed over the detected bump or surface irregularity (such as by calculating the distance traveled based on the speed of travel and/or determining when the distance traveled since the bump detection is at least equal to the distance between the front and rear wheels or axles, or by other suitable distance or time or speed detecting or determining means). After the control determines that the front wheels have passed the detected bump, the control may increase the speed of travel of the machine to resume the previous speed of travel before the bump was detected.

The control system of the present invention thus provides an enhanced plowing or screeding device and method that allows for faster passes over the concrete surface, This is because the machine may travel at a greater speed when the wheels are traveling over a substantially smooth subgrade surface, but the speed of the machine is automatically reduced when surface irregularities are encountered, thereby providing enhanced responsiveness to the tilt control at the front frame portion or screed head assembly. Thus, the operator may set the speed of the machine to a desired level for smooth subgrades, and the control system will automatically adjust the speed to an appropriate speed level when bumps or other surface irregularities are encountered by the machine. It is envisioned that the control system may adjust or vary the degree of reduction in speed depending on the size or height of the bump that is detected or encountered by the rear wheel or wheels of the machine.

Optionally, and particularly for plowing or raking or screeding machines of the present invention with two-wheeled supports or bases or units (such two-wheeled devices as of the types described in U.S. Pat. Nos. 4,655,633; 4,930,935; 6,129,481; 6,152,647; 6,183,160; 6,588,976; and/or 6,623,208; and/or U.S. patent application Ser. No. 10/728,620, filed Dec. 5, 2003, now U.S. Pat. No. 6,953,304; Ser. No. 10/266,305, filed Oct. 2, 2002, now U.S. Pat. No. 6,976,805; and/or Ser. No. 10/902,528, filed Jul. 29, 2004, now U.S. Pat. No. 7,121,762, which are hereby incorporated herein by reference), the bump detecting device or system may comprise a movable sensing device, such as a wheel or roller or the like, that may be positioned generally ahead of each wheel of the wheeled support (in the rearward direction of travel) to encounter and detect any bump or subgrade surface irregularity before the respective wheel encounters the bump or surface irregularity. For example, a wheel or roller may be mounted on an arm that extends rearward and downward from the wheeled support, whereby a detected upward movement of the arm (such as upward pivotal movement of the arm) is indicative of the wheel or roller encountering a bump at the subgrade surface.

Therefore, when one or both of the front wheels encounter the detected bump or surface irregularity, the machine travel speed is reduced to a reduced level so that the control and tilt actuator 338 may more readily substantially maintain the screed head in the level or desired orientation as the front wheels 324 and axle assembly 325 twist or pivot as the front wheels encounter and roll over the bump. The sensed event at the rear wheels is thus used to automatically slow (anticipate) the travel speed of the machine such that screeding can continue at a reduced machine travel speed during the controller-calculated duration of the bump event. The front frame cross slope control system helps keep the boom and screed head substantially level in the cross slope direction, and the temporary slowing of the machine's travel speed helps keep the control system responses within the capabilities of the respective components. Then, when the machine has cleared the bump event after a controller-calculated amount of travel distance (such as sensed by wheel encoders or the like), the machine can resume its previous travel speed. If no further bump (rear frame cross slope) signals are generated and the subgrade remains substantially smooth or even, the screeding machine can continue screeding at the faster travel speed. Although shown and described as detecting a side-to-side tilt of the rear frame portion and slowing the machine down in anticipation of a similar side-to-side tilt of the front frame portion and screed head, the machine of the present invention may also detect a change in pitch of the rear frame portion (such as may happen when both wheels encounter the same bump or surface irregularity) and the machine may slow down in anticipation of similar encounter by the wheels/tires of the front frame portion (in order to provide a pitch adjustment of the screed head assembly while the machine is traveling at a reduced rate).

Figure 19:
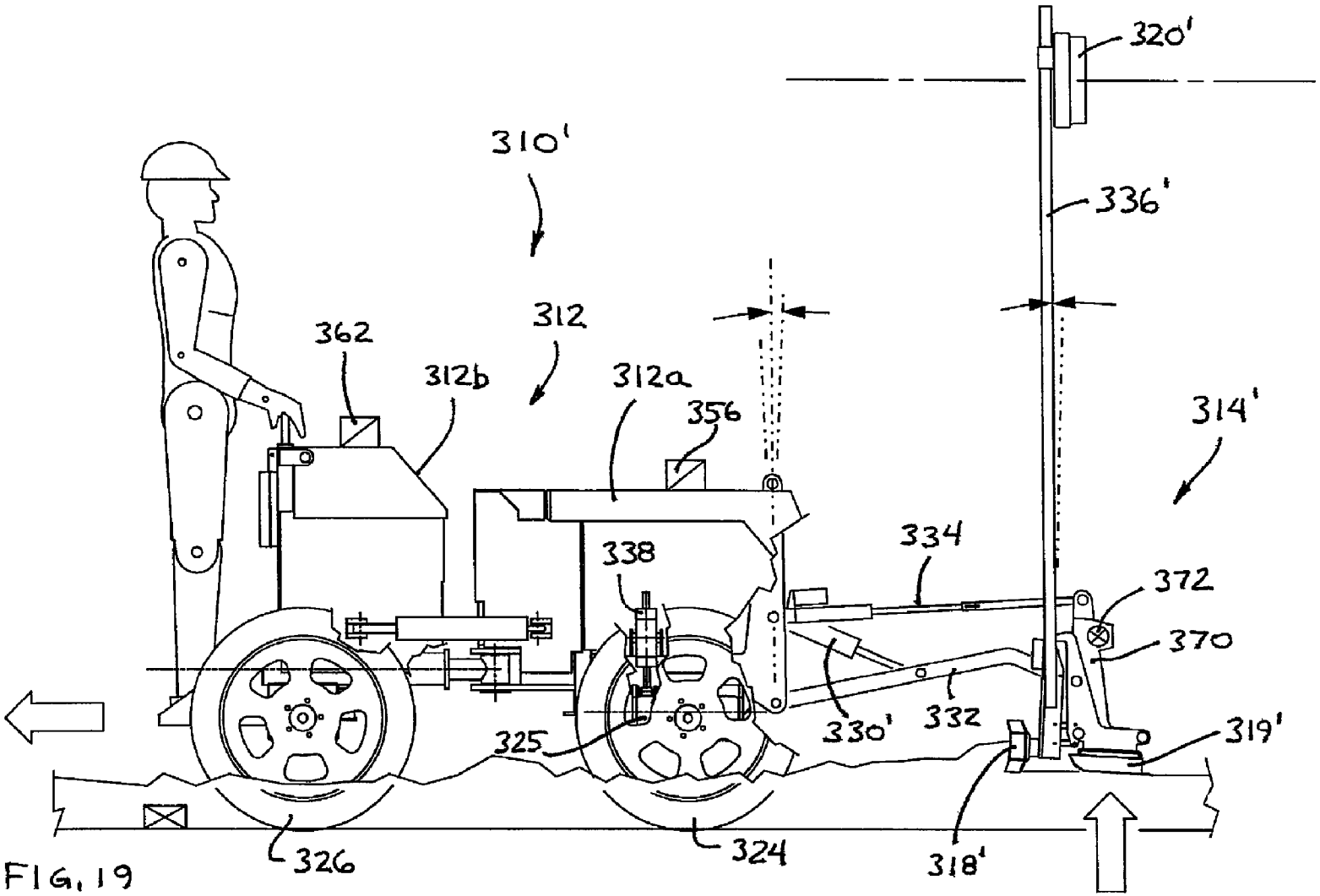
FIG. 19 is a side elevation of another powered screeding device in accordance with the present invention.

Optionally, and as shown in FIG. 19, a concrete working or processing device or machine 310' may include the wheeled support 312 and a screed head assembly 314' mounted at the front frame portion 312*a* of the wheeled support 312. The screed head assembly 314' includes a frame 370, a vibrating member 319' mounted at the frame 370 and a plow member 318' that is adjustably mounted at the frame 370, and that is adjustable via a pair of actuators and in response to respective laser receivers 320' on masts 336' to establish the grade of the concrete so that the vibrating member may vibrate, compact and smooth the concrete to the desired grade as the machine moves over the subgrade and concrete. In the illustrated embodiment, screed head assembly 314' is attached at the front frame portion 312*a* and generally floats on or is supported by the concrete surface, such as in the manner described in U.S. patent application Ser. No. 10/728,620, filed Dec. 5, 2003, now U.S. Pat. No. 6,953,304; Ser. No. 10/266,305, filed Oct. 2, 2002, now U.S. Pat. No. 6,976,805; and Ser. No. 10/902,528, filed Jul. 29, 2004, now U.S. Pat. No. 7,121,762, which are hereby incorporated herein by reference. The actuators may be responsive to the respective laser receivers at or near opposite ends of the screed head assembly and may be adjusted or controlled to adjust the degree of cutting into the concrete so as to establish the desired grade for the floating vibrating member as the machine is moved along the concrete. Optionally, the screed head may also include an auger, such as described above.

In the illustrated embodiment, screed head assembly 314' is pivotally mounted to front frame portion 312*a* via an upper arm linkage 334 and a lower arm linkage 332, and may be raised and lowered relative to the front frame portion 312*a* via a lift cylinder or actuator 330'. During the screeding operation, the screed head is allowed to float upon the concrete surface at the vibrating member by substantially free pivoting movement at the upper and lower lift arm linkages and through selected free movement or free floating of the lift-arm cylinder. With this design, the front cross slope or tilt sensor may be located on the vibrating member resting upon the surface of the concrete, whereby the plow actuators may be responsive to the tilt sensor to substantially maintain the screed head assembly in the desired orientation, while both the front axle and the rear frame portion of the machine are free to oscillate over uneven subgrade surfaces through their respective longitudinal pivot axes.

Optionally, the upper link 334 of the lift arm linkage may be an adjustable length linkage, and may include a linear actuator, such as an electric linear actuator or the like. The linear actuator may comprise a substantially rigid member, and may be automatically adjusted to change its length according to a signal from a pitch level sensor 372 on the screed head frame 370. The pitch level sensor 372 may sense the pitch or fore-aft tilt of the screed head assembly as the screed head assembly may tilt when the wheels of the wheeled unit encounter bumps or inclines in the subgrade. Such an adjustable lift arm linkage and pitch sensor arrangement may enable the pitch of the screed head to be controlled so as to remain substantially constant as the wheels of the machine encounter bumps or inclines in the subgrade. As described above, the rear frame portion may include a pitch detecting sensor and the control may slow the rate of travel of the machine when a sufficient or threshold pitch change is detected, in anticipation of the front wheels/tires and the screed head assembly encountering a similar pitch change.

Depending on the design weight of the screed head and the conditions of the concrete, it may be desirable to either add or subtract "weight" at the screed head. Thus, the normally free floating lift cylinder 330' may optionally and selectively act as a "constant force" actuator as selected by the operator, whereby the operator may cause the actuator or cylinder to extend or retract or become substantially rigid or locked. Such an application may allow the operator to increase or decrease a down pressure of the screed head assembly onto the concrete surface so as to adjust the desired amount of force the vibrating/floating member exerts upon the surface of the concrete. Optionally, the machine may include variably adjustable torsional springs or other biasing elements or springs or the like at the pivot between the lower lift arm and the front frame portion. Such an arrangement may counteract the weight of the screed head through the range of movement of the screed head, such as in a similar manner as the torsional springs used on overhead garage doors counteract the weight of the door through its range of movement.

The machine may also include the bump anticipation and speed control system described above, where the actuator 338 may maintain the front frame portion 312*a* in a substantially level or desired orientation as the front wheels encounter and roll over a bump (and at a reduced speed due to the prior detection of the bump by the bump detection device or sensor at the rear frame portion). Optionally, however, the front level sensor or cross slope or tilt sensor 356 may be removed in this embodiment, since a tilt sensor may be provided at the screed head assembly.

Figure 20:
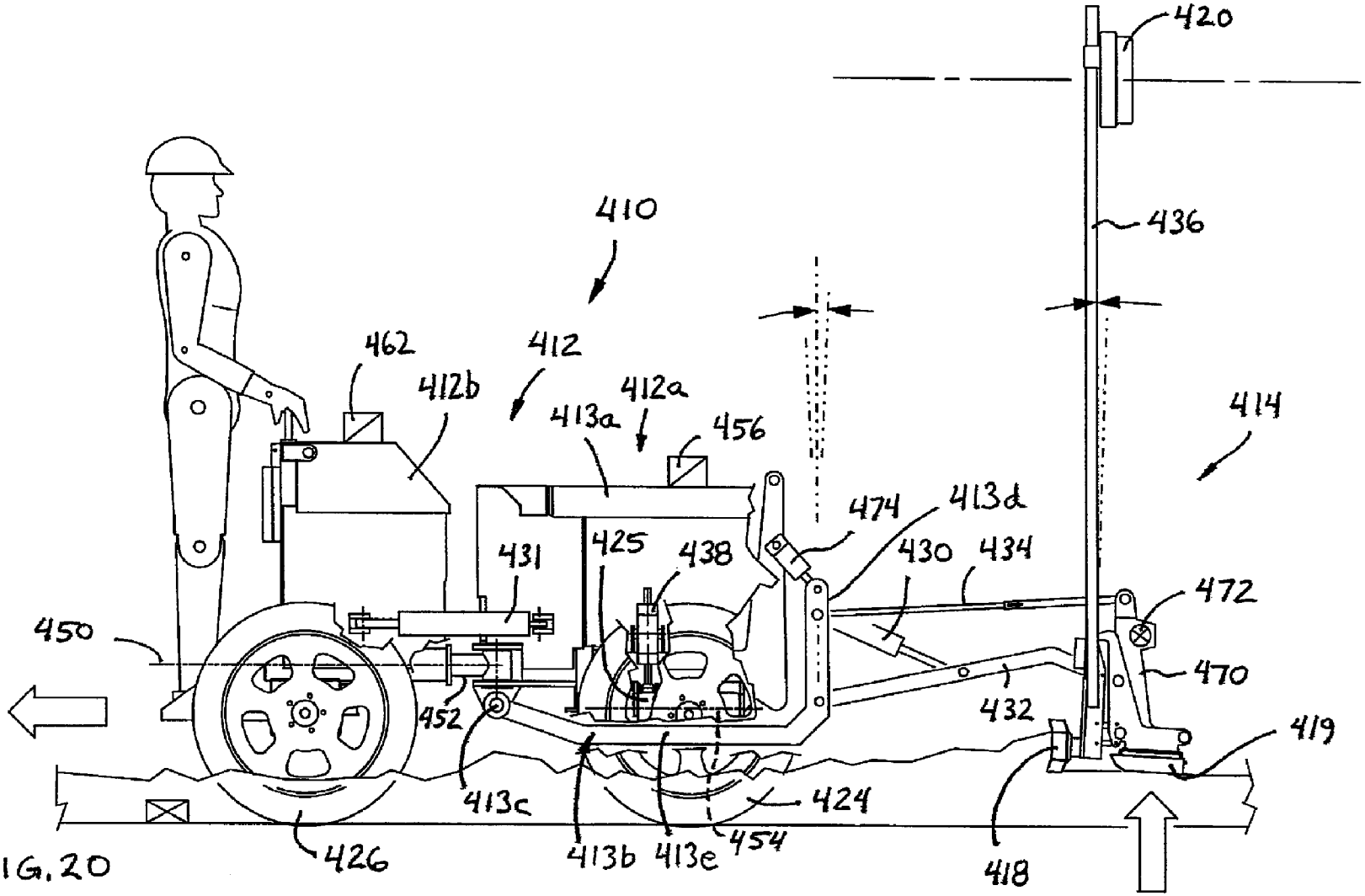
FIG. 20 is a side elevation of another powered screeding device in accordance with the present invention.

Optionally, and with reference to FIG. 20, a concrete working or plowing or screeding machine 410 of the present invention may include a wheeled support or base or unit 412, with a screed head assembly 414 mounted at a front or forward end of wheeled support 412. The screed head assembly 414 may be substantially similar to screed head assembly 314', discussed above, and may be mounted to the wheeled support so as to substantially float on or be supported by the concrete surface in a similar manner as described above, such that a detailed discussion of the screed head assemblies will not be repeated herein. Common or similar components or elements of the screed head assemblies are shown in FIG. 20 with the similar reference numbers as used in FIG. 19, but with 100 added to each reference number.

Also, the wheeled support 412 may be substantially similar to the wheeled support 312, discussed above, such that a detailed discussion of the wheeled supports will not be repeated herein. However, a front portion 412*a* of wheeled support 412 includes a front frame portion 413*a*, which is pivotally mounted to the axle assembly 425 and pivotable relative to the axle assembly via actuator 438 (such as described above), and includes a pivotable support arm or support frame 413*b* that is pivotally attached to front frame portion 413*a* and pivotable about a generally horizontal axis 413*c*. The screed head assembly 414 is mounted to a forward portion 413*d* of pivotable support frame 413*b* via the linkages 432, 434 and actuator 430 (such as in a similar manner as screed head assembly 314' is mounted to front frame portion 312*a* as described above).

As can be seen in FIG. 20, the pivot axis 413*c* of the support frame 413*b* is generally horizontal and generally perpendicular to the direction of travel of the machine. The generally mid-point attachment of the support frame to the front frame portion of the wheeled support may reduce the effects of unwanted elevation changes at the lift arm and unwanted changes in the pitch (attack angle) of the screed head as the wheels of the machine may travel over bumps and irregularities within the subgrade. The pivotable support frame is pivotally attached to the wheeled support near its midpoint and well rearward of the forward end of the wheeled support because such an arrangement reduces elevation changes to the lift arm linkages (and thus to the screed head assembly) as the machine if moved through the concrete. This is a desirable arrangement, since it is desirable to maintain a generally horizontal pitch attitude of the screed head assembly while screeding, so as not to upset the desired attack angle of the screed head.

The forward end portion 413*d* of the pivotable support frame 413*b* may be adjustably connected to the forward end of the front frame portion 413*a* via an adjustable actuator 474 or the like. During operation of the concrete working device or machine, the actuator 474 between the support frame and the front portion of the front frame portion is allowed to freely extend and retract. However, the small actuator 474 may be selectively locked in a fixed position to allow the lift cylinder or actuator 430 to raise or lift the screed head out of the concrete. When the actuator 474 is in its free float mode, the screed head assembly is supported by the vibrating member on the concrete, such as described in U.S. patent application Ser. No. 10/728,620, filed Dec. 5, 2003, now U.S. Pat. No. 6,953,304; Ser. No. 10/266,305, filed Oct. 2, 2002, now U.S. Pat. No. 6,976,805; and Ser. No. 10/902,528, filed Jul. 29, 2004, now U.S. Pat. No. 7,121,762, which are hereby incorporated herein by reference.

It is further envisioned that the actuator 474 may also function as a constant-force actuator to help control the desired amount of either down pressure or up pressure at the vibrating member as it is partially supported on the surface of the concrete. A pressure sensor or load cell (not shown) may be mounted between the vibrator and the frame of the screed head, and may sense the amount of vertical force the vibrator is exerting on the concrete surface. An output signal the pressure sensor or load cell may be directed to a controller to adjust the output force of the constant-force actuator to provide a desired down-pressure at the concrete surface.

Optionally, the forward end portion 413*d* of support frame 413*b* may be pivotally attached to the generally horizontal portion 413*e* of support frame 413*b* and thus may be pivotable about a generally vertical pivot axis at the forward end of the horizontal portion 413*e* of support frame 413*b*. Such a pivotal arrangement allows pivotal movement of the screed head assembly about the vertical pivot axis and relative to the wheeled support to reduce or alleviate sideward movement of the screed head assembly when the articulating wheeled support is articulated or steered to one side or the other. Optionally, an actuator (not shown) or the like may be provided to selectively allow the support frame to be locked or to float about the generally vertical pivot axis. The actuator may be actuatable to control or adjust the position or orientation of the support frame about the pivot axis and in the sidewardly direction relative to the wheeled support.

Although shown and described as being driven over a subgrade surface and being operable to plow or establish a desired grade of the concrete and/or to vibrate or screed the uncured concrete, aspects of the wheeled working or processing devices or machines of the present invention may be suitable for plowing or screeding other materials as well, such as subgrade materials (such as dirt, sand, gravel or the like) or other uncured materials placed or poured on subgrade surfaces (such as other types of concrete, cement, asphalt or the like), without affecting the scope of the present invention.

The present invention thus may provide a concrete working or processing device or machine that includes a plow assembly for striking off concrete and/or a screed head assembly for screeding or smoothing and compacting the concrete. The plow head or screed head assembly may be mounted to a two-wheeled or three-wheeled or four-wheeled unit or base and may be adjustable relative to the wheeled unit in response to a laser receiver to establish and/or screed the concrete at the desired grade. Optionally, the plow or screed head assembly may be mounted at the wheeled unit and may substantially freely float relative to the wheeled unit, whereby the grade is established via a grade setting device or plow of the plow/screed head assembly in response to actuators and laser receivers at the plow/screed head assembly. The machine may include a control system that is operable to automatically raise the plow/screed head assembly after a pass and may hold the plow/screed head assembly at the raised position while the machine is moved to the beginning of another pass along and through the concrete. The machine may include a control system that includes a down-pressure control that controls or increases/reduces the down pressure applied by the plow/screed head assembly at the concrete surface, so that the plow/screed head assembly may rise over excessive concrete that may accumulate at the plow as the plow/screed head assembly is moved over the concrete surface. The machine may include a control system that may detect a bump or surface irregularity at the subgrade and that may automatically adjust the speed of the wheeled unit in response to the detection of the bump or uneven terrain by one of the wheels of the wheeled unit, so that the machine may reduce the speed over uneven terrain to allow for enhanced grading or screeding of the concrete in those areas by providing additional time for the machine to adjust and maintain the plow/screed head assembly in a generally horizontal orientation.

Therefore, the present invention may serve to produce a desired and rough but substantially accurate strike-off of a concrete surface in order to facilitate and complement concrete placing and screeding operations that may follow, as well as generally smooth and accurately level loose and spreadable materials for subgrade preparation found within the construction industry. A further advantage of this machine is that the machine operator can stand and ride upon the machine with his feet out of the concrete and/or loose materials. This improves ease of use of the machine and personal safety during the use of the machine. For example, the operator is not as likely to catch his feet in loose materials such as uncured concrete or trip upon objects obscured by loose and flowable materials. Additionally, higher machine travel speeds are possible and a commanding view of the work area are provided with the operator in a stand-and-ride-on design. This provides a significant increase in productivity of the machine over walk-behind versions. Additionally, the machine of the present invention provides a high level of utilization to the owner operator within the concrete construction industry in that it can optionally be adapted for use as a concrete coatings sprayer, a laser responsive screeding machine, a concrete pumping hose handler, and a surface sweeper. The machine may be suitable for other applications as well, without affecting the scope of the present invention.

The present invention may also provide an apparatus and method for achieving a desired and accurate strike-off of an uncured concrete surface in order to facilitate and compliment concrete placing and screeding operations that may follow, as well as generally smooth and accurately level loose and spreadable materials for subgrade preparation found within the construction industry. The apparatus or machine may be moved in either direction to strike-off or establish the desired grade or level of the uncured concrete or subgrade material. The plow is automatically adjusted to maintain the desired grade or level in response to a laser reference system, so that the uncured concrete or subgrade materials are struck-off at the appropriate level over the targeted area. The wheels of the machine may be independently operable or controlled to move the machine over and through the uncured concrete or subgrade materials and to turn or steer the machine as it is moved over and through the uncured concrete or subgrade materials. The rear wheel may be steered via a handlebar or the like to further enhance the steering and controlling of the machine as it is moved over and through the uncured concrete or subgrade materials. Optionally, the wheeled base unit may comprise an articulatable frame with front and rear wheels. One frame portion may support a plow head or screed head or other attachment or head assembly or the like, while the other frame portion may provide an operator control station with a platform on which the operator may stand during the plowing or striking off or screeding or other concrete processing operation.

The present invention may also provide a sidewalk screeding machine that is operable to establish an initial grade that is slightly above the final grade and then to screed the uncured concrete at the initial grade and compact and vibrate the uncured concrete to the final grade, without the use of laser leveling or grade setting systems or the like. The plow rides on forms and the lower edge of the plow is spaced above the level of the forms by the spacer members or elements such that the plow cuts and establishes a grade that is above the level of the forms. The planar portion or surface of the vibrating member rests on and moves along the forms behind the plow such that the planar surface vibrates and compacts and screeds and smoothes the excess concrete to the level set by the forms. The plow thus functions to cut or establish an initial grade or level of the uncured concrete that is above the level or grade at which the vibrating member will vibrate and screed the concrete. The plow thus leaves a small amount of excess concrete for the vibrating member to compact and screed so that the vibrating member provides an enhanced surface of the concrete slab.

Changes and modifications in the specifically described embodiments may be carried out without departing from the principles of the present invention, which is intended to be limited only by the scope of the appended claims, as interpreted according to the principles of patent law.

The embodiments of the invention in which an exclusive property right or privilege is claimed are defined as follows:

1. A wheeled concrete screeding device for screeding uncured concrete, said wheeled concrete screeding device comprising:

a wheeled unit having at least two wheels for movably supporting a frame portion of said wheeled unit, said frame portion having a forward end and a rearward end, wherein said wheeled unit is movable through uncured concrete in a screeding direction;

a screed head supported at said rearward end of said frame portion and following behind said wheeled unit when said wheeled unit is moved in said screeding direction, said screed head comprising a grade establishing element and a vibratable member;

wherein said grade establishing element is generally vertically adjustable responsive to a signal from a laser receiver disposed at said screed head to establish a struck-off surface of the uncured concrete at a desired grade when said wheeled unit is moved in said screeding direction; and wherein said vibratable member is adjustably attached at a rearward end of said grade establishing element and wherein said vibratable member at least partially floats behind said grade establishing element on the struck-off surface of the uncured concrete and is at least partially supported at the struck-off surface of the uncured concrete as said wheeled unit is moved in said screeding direction.

2. The wheeled concrete screeding device of claim 1, wherein said grade establishing element comprises a plow member.

3. The wheeled concrete screeding device of claim 2, wherein said grade establishing element comprises an auger disposed behind said plow member, and wherein said auger is generally vertically adjustable with said plow member.

4. The wheeled concrete screeding device of claim 3, wherein said rearward end of said grade establishing element comprises a rearward end of said auger and wherein said vibratable member is adjustably attached at said rearward end of said auger.

5. The wheeled concrete screeding device of claim 1, wherein said vibratable member is pivotally attached at said rearward end of said grade establishing element.

6. The wheeled concrete screeding device of claim 5, wherein said vibratable member is pivotally attached at said rearward end of said grade establishing element via a pair of links that are pivotally attached at said rearward end of said grade establishing element.

7. The wheeled concrete screeding device of claim 5, wherein said vibrating member is pivotally attached at at least one bracket at said rearward end of said grade establishing element.

8. The wheeled concrete screeding device of claim 7, wherein said vibrating member is pivotally attached at said at least one bracket via at least one mounting pin.

9. The wheeled concrete screeding device of claim 7, wherein said vibrating member is securable relative to said at least one bracket to retain said vibrating member at a desired attack angle as said vibrating member is moved in said screeding direction behind said grade establishing element.

10. The wheeled concrete screeding device of claim 1, wherein said wheeled unit comprises a pair of front wheels supporting a front frame portion and a pair of rear wheels supporting a rear frame portion, wherein said screed head is supported at a rearward end of said rear frame portion.

11. The wheeled concrete screeding device of claim 10, wherein said wheeled unit comprises an articulatable wheeled unit and wherein said front frame portion is articulatable relative to said rear frame portion about a generally vertical pivot axis when said wheeled unit is supported at a generally horizontal support surface.

12. The wheeled concrete screeding device of claim 11, wherein said front frame portion includes a platform at its forward end, and wherein said platform supports an operator of said wheeled concrete screeding device during operation of said wheeled concrete screeding device.

13. A wheeled concrete screeding device for screeding uncured concrete, said wheeled concrete screeding device comprising:

an articulatable wheeled unit having a front frame portion movably supported by front wheels and a rear frame portion movably supported by rear wheels, wherein said front frame portion is articulatable relative to said rear frame portion about a generally vertical pivot axis when said wheeled unit is supported at a generally horizontal support surface, wherein said articulatable wheeled unit is movable through uncured concrete in a screeding direction;

a screed head supported at a rearward end of said rear frame portion so that said screed head follows behind said articulatable wheeled unit when said articulatable wheeled unit is moved in said screeding direction, said screed head comprising a grade establishing element and a vibratable member, wherein said grade establishing element comprises a plow member;

wherein said grade establishing element is generally vertically adjustable relative to said rear frame portion responsive to a signal from a laser receiver disposed at said screed head to establish a struck-off surface of the uncured concrete at a desired grade when said articulatable wheeled unit is moved in said screeding direction;

wherein said vibratable member is pivotally attached at a rearward end of said grade establishing element, and wherein said vibratable member at least partially floats behind said grade establishing element on the struck-off surface of the uncured concrete and is at least partially supported at the struck-off surface of the uncured concrete as said articulatable wheeled unit is moved in said screeding direction.

14. The wheeled concrete screeding device of claim 13, wherein said grade establishing element comprises an auger disposed behind said plow member, and wherein said auger is generally vertically adjustable with said plow member, and wherein said rearward end of said grade establishing element comprises a rearward end of said auger and wherein said vibratable member is pivotally attached at said rearward end of said auger.

15. The wheeled concrete screeding device of claim 13, wherein said front frame portion includes a platform at its forward end, and wherein said platform supports an operator of said wheeled concrete screeding device during operation of said wheeled concrete screeding device.

16. A method of establishing a desired grade of an uncured concrete surface, said method comprising:

providing a wheeled concrete working device having a wheeled support having a frame portion and a pair of wheels rotatably mounted at said frame portion, wherein said wheeled support comprises a plow assembly mounted at said frame portion, said plow assembly including at least one plow member for engaging the uncured concrete;

moving said wheeled concrete working device in a screeding direction;

adjusting an elevation of said plow member in response to a signal from a laser receiver mounted at said plow assembly to establish a desired grade of the concrete when said wheeled concrete working device is moved in said screeding direction;

detecting a surface irregularity of the subgrade upon which the wheels travel and at a location forward of either of said wheels and in the screeding direction of travel of said wheeled concrete working device;

reducing the speed of said wheeled concrete working device in said screeding direction in response to a detection of a surface irregularity; and controlling at least one of said frame portion and said plow assembly to substantially maintain said plow assembly at a desired orientation when at least one of said wheels engages the detected surface irregularity.

17. The method of claim 16 comprising increasing the speed of said wheeled concrete working device in said screeding direction after said wheels have passed the detected surface irregularity.

18. The method of claim 16, wherein said frame portion of said wheeled support comprises a forward frame portion supported by a pair of front wheels and a rearward frame portion pivotally attached to said forward frame portion and supported by a pair of rear wheels, and wherein said plow assembly is mounted to said rearward frame portion, and wherein detecting a surface irregularity comprises detecting a tilt of said forward frame portion about a longitudinal axis of said forward frame portion.

19. The method of claim 18, wherein controlling at least one of said frame portion and said plow assembly comprises controlling at least one of said rearward frame portion and said plow assembly in response to a detection of a tilt that is indicative of one of said front wheels engaging a surface irregularity.

20. The method of claim 16 comprising rotatably driving said wheels to move said wheeled concrete working device over and through the uncured concrete surface in said screeding direction.

* * * * *

UNITED STATES PATENT AND TRADEMARK OFFICE

CERTIFICATE OF CORRECTION

PATENT NO. : 8,038,366 B2
APPLICATION NO. : 12/951532
DATED : October 18, 2011
INVENTOR(S) : Philip D. Halonen et al.

It is certified that error appears in the above-identified patent and that said Letters Patent is hereby corrected as shown below:

Column 1
Line 37, “machines;” should be --machines--

Column 4
Line 3, “plow,” should be --plow.--

Column 7
Line 17, “aim” should be --arm--
Line 26, Insert --.-- after “machine”

Column 12
Line 26, “foul’s” should be --forms--

Column 15
Line 10, Insert --.-- after “machine”

Column 17
Line 4, Insert --.-- after “machine”
Line 53, “FIG,” should be --FIG.--

Column 19
Line 31, “surface,” should be --surface.--

Column 22
Line 63, Insert --from-- after “signal”

Signed and Sealed this
Twenty-seventh Day of March, 2012

David J. Kappos

David J. Kappos
*Director of the United States Patent and Trademark Office*